US007294056B2

(12) United States Patent
Lowell et al.

(10) Patent No.: US 7,294,056 B2
(45) Date of Patent: Nov. 13, 2007

(54) ENHANCED GAMING SYSTEM

(75) Inventors: Mark Lowell, Reno, NV (US); Michael W. Hartman, Reno, NV (US); Calvin Nicholson, Reno, NV (US); Hong J. Kim, Reno, NV (US); Joseph Kisenwether, Reno, NV (US); Stephen E. Patton, Reno, NV (US)

(73) Assignee: GameTech International, Inc., Reno, NV (US)

( * ) Notice: Subject to any disclaimer, the term of this patent is extended or adjusted under 35 U.S.C. 154(b) by 558 days.

(21) Appl. No.: 10/743,350

(22) Filed: Dec. 23, 2003

(65) Prior Publication Data

US 2004/0185931 A1 Sep. 23, 2004

Related U.S. Application Data

(60) Provisional application No. 60/502,675, filed on Sep. 15, 2003, provisional application No. 60/501,557, filed on Sep. 9, 2003, provisional application No. 60/435,274, filed on Dec. 23, 2002.

(51) Int. Cl.
*A63F 9/24* (2006.01)

(52) U.S. Cl. ..... 463/17; 463/42

(58) Field of Classification Search ..... 463/17, 463/20, 40, 42

See application file for complete search history.

(56) References Cited

U.S. PATENT DOCUMENTS

| | | | | |
|---|---|---|---|---|
| 3,900,219 | A | 8/1975 | D'Amato et al. | 283/6 |
| 4,033,611 | A | 7/1977 | Johnsen | 283/6 |
| 4,087,092 | A | 5/1978 | Krause et al. | 273/138 A |
| 4,157,829 | A | 6/1979 | Goldman et al. | 273/138 A |
| 4,373,726 | A | 2/1983 | Churchill et al. | 273/138 A |
| 4,491,319 | A | 1/1985 | Nelson | 273/1 R |
| 4,494,197 | A | 1/1985 | Troy et al. | 364/412 |
| 4,582,324 | A | 4/1986 | Koza et al. | 273/138 |
| 4,652,998 | A | 3/1987 | Koza et al. | 364/412 |
| 4,669,729 | A | 6/1987 | Solitt et al. | 273/138 A |
| 4,677,553 | A | 6/1987 | Roberts et al. | 364/412 |
| 4,689,742 | A | 8/1987 | Troy et al. | 364/412 |
| 4,725,079 | A | 2/1988 | Koza et al. | 283/73 |
| 4,740,016 | A | 4/1988 | Konecny et al. | 283/903 |
| 4,817,949 | A | 4/1989 | Bachman et al. | 273/139 |
| 4,817,951 | A | 4/1989 | Crouch et al. | 273/143 R |
| 4,832,341 | A | 5/1989 | Muller et al. | 273/139 |
| 4,837,728 | A | 6/1989 | Barrie et al. | 364/412 |
| 4,839,507 | A | 6/1989 | May | 235/381 |
| 4,842,278 | A | 6/1989 | Markowicz | 273/138 A |
| 4,880,964 | A | 11/1989 | Donahue | 235/462 |
| 4,943,090 | A | 7/1990 | Fienberg | 273/139 |
| 4,982,337 | A | 1/1991 | Burr et al. | 364/479 |
| 5,007,641 | A | 4/1991 | Seidman | 273/138 A |
| 5,037,099 | A | 8/1991 | Burtch | 273/139 |

(Continued)

*Primary Examiner*—Robert E Pezzuto
(74) *Attorney, Agent, or Firm*—Dillon & Yudell LLP

(57) ABSTRACT

An enhanced gaming system through which a variety of games of chance and/or games of skill can be made available to players. The gaming system separates game outcomes from game themes and game payout/buy-in information, thereby enhancing game flexibility. The gaming system also allows different games of chance and/or games of skill to be available to different subsets of player units, and gives a gaming hall operator the ability to dynamically control the size and distribution of such subsets. An "apparently random" permutation production technique is disclosed for use in certain games and regulatory environments. A PKI-based architecture is also disclosed.

20 Claims, 18 Drawing Sheets

U.S. PATENT DOCUMENTS 5,039,848 A 8/1991 Stoken ..... 235/381
5,042,809 A 8/1991 Richardson ..... 273/138 A
5,046,737 A 9/1991 Fienberg ..... 273/139
5,092,598 A 3/1992 Kamille ..... 273/139
5,118,109 A 6/1992 Gumina ..... 273/139
5,158,293 A 10/1992 Mullins ..... 273/139
5,193,815 A 3/1993 Pollard ..... 273/269
5,217,258 A 6/1993 Sanderson ..... 283/105
5,222,624 A 6/1993 Burr ..... 221/1
5,259,133 A 11/1993 Burtch ..... 40/124.1
5,290,033 A 3/1994 Bittner et al. ..... 273/138 A
5,316,166 A 5/1994 Pavely et al. ..... 220/269
5,324,035 A 6/1994 Morris et al. ..... 273/138 A
5,335,822 A 8/1994 Kasper ..... 221/259
5,344,144 A 9/1994 Canon ..... 273/138 A
5,348,299 A 9/1994 Clapper, Jr. ..... 273/138 A
5,372,386 A 12/1994 Mills ..... 283/67
5,377,975 A 1/1995 Clapper, Jr. ..... 273/138 A
5,398,932 A * 3/1995 Eberhardt et al. ..... 463/29
5,407,199 A 4/1995 Gumina ..... 273/139
5,407,200 A 4/1995 Zalabak ..... 273/139
5,451,052 A 9/1995 Behm et al. ..... 273/139
5,471,039 A 11/1995 Irwin, Jr. et al. ..... 235/441
5,475,205 A 12/1995 Behm et al. ..... 235/375
5,487,544 A 1/1996 Clapper, Jr. ..... 273/138 A
5,536,008 A 7/1996 Clapper, Jr. ..... 463/16
5,560,610 A 10/1996 Behm et al. ..... 273/269
5,562,284 A 10/1996 Stevens ..... 273/139
5,580,311 A 12/1996 Haste, III ..... 463/29
5,595,538 A 1/1997 Haste, III ..... 463/17
5,609,337 A 3/1997 Clapper, Jr. ..... 273/138.2
5,645,485 A 7/1997 Clapper, Jr. ..... 463/17
5,647,592 A 7/1997 Gerow ..... 273/139
5,657,899 A 8/1997 Stoken ..... 221/1
5,657,991 A 8/1997 Camarato ..... 273/269
5,674,128 A * 10/1997 Holch et al. ..... 463/42
5,735,432 A 4/1998 Stoken et al. ..... 221/1
5,749,784 A 5/1998 Clapper, Jr. ..... 463/17
5,770,533 A * 6/1998 Franchi ..... 463/42
5,810,664 A 9/1998 Clapper, Jr. ..... 463/17
5,857,911 A 1/1999 Fioretti ..... 463/40
5,871,398 A 2/1999 Schneier et al. ..... 463/16
5,915,585 A 6/1999 Ladina et al. ..... 220/522
5,915,588 A 6/1999 Stoken et al. ..... 221/2
5,928,082 A 7/1999 Clapper, Jr. ..... 463/16
5,934,671 A 8/1999 Harrison ..... 273/139
5,935,002 A 8/1999 Falciglia ..... 463/19
5,941,771 A 8/1999 Haste, III ..... 463/17
5,944,606 A 8/1999 Gerow ..... 463/27
5,949,042 A 9/1999 Dietz, II et al. ..... 235/375
5,951,396 A 9/1999 Tawil ..... 463/19
5,971,195 A 10/1999 Reidinger et al. ..... 220/521
5,980,385 A 11/1999 Clapper, Jr. ..... 463/17
5,984,779 A 11/1999 Bridgeman et al. ..... 463/16
5,984,799 A 11/1999 Romano ..... 473/234
6,012,984 A 1/2000 Roseman ..... 463/42
6,032,820 A 3/2000 Ladina et al. ..... 220/522
6,110,044 A 8/2000 Stern ..... 463/29
6,149,522 A 11/2000 Alcorn et al. ..... 463/29
6,183,361 B1 2/2001 Cummings et al. ..... 463/18
6,186,892 B1 2/2001 Frank et al. ..... 463/19
6,220,961 B1 4/2001 Keane et al. ..... 463/16
6,280,325 B1 8/2001 Fisk ..... 463/19
RE37,371 E 9/2001 Gerow ..... 273/139
6,293,424 B1 9/2001 Love ..... 221/4
6,306,038 B1 10/2001 Graves et al. ..... 463/40
6,309,298 B1 10/2001 Gerow ..... 463/20
6,311,860 B1 11/2001 Reidinger et al. ..... 220/521
6,354,941 B2 3/2002 Miller et al. ..... 463/19
6,390,916 B1 5/2002 Brown ..... 463/17
6,398,645 B1 6/2002 Yoseloff ..... 463/19
6,402,614 B1 6/2002 Schneier et al. ..... 463/17
6,435,408 B1 8/2002 Irwin, Jr. et al. ..... 235/441
6,435,500 B2 8/2002 Gumina ..... 273/139
6,447,395 B1 9/2002 Stevens ..... 463/18
6,491,215 B1 12/2002 Irwin, Jr. et al. ..... 235/375
6,527,175 B1 3/2003 Dietz et al. ..... 235/381
6,543,808 B1 4/2003 Mitchell, Jr. et al. ..... 283/49
6,599,187 B2 7/2003 Gerow ..... 463/17
6,607,439 B2 8/2003 Schneier et al. ..... 463/17
6,648,755 B1 11/2003 Luciano, Jr. et al. ..... 463/17
2001/0019193 A1 9/2001 Gumina ..... 273/139
2001/0036855 A1 11/2001 Defrees-Parrot et al. ..... 463/17
2002/0039917 A1 4/2002 Armstrong et al. ..... 463/16
2002/0072404 A1 6/2002 Gerow ..... 463/27
2002/0082070 A1 6/2002 Macke et al. ..... 463/16
2002/0098882 A1 7/2002 Lind et al. ..... 463/17
2002/0098888 A1* 7/2002 Rowe et al. ..... 463/39
2002/0173354 A1* 11/2002 Winans et al. ..... 463/20
2003/0030211 A1 2/2003 Brown ..... 273/139
2003/0067109 A1 4/2003 Such ..... 273/138.1

* cited by examiner

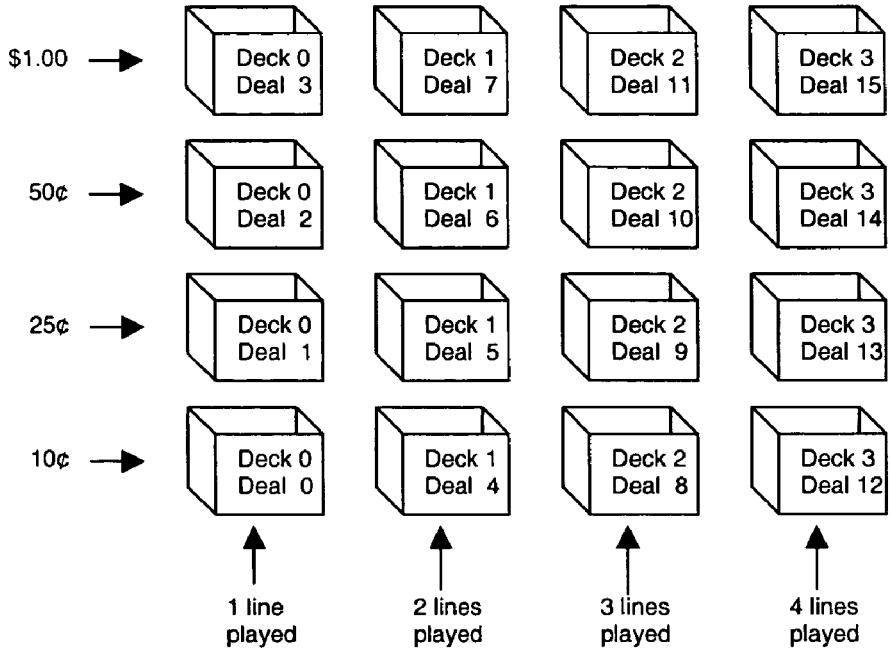
Figure 7
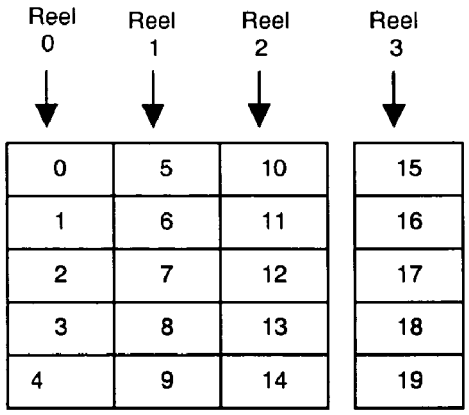
Figure 8
| Symbol(s) | Symbol ID |
|---|---|
| Seven / Race 0 | 0 |
| Horse Shoe / Race 1 | 1 |
| Bell / Race 2 | 2 |
| Watermelon / Race 3 | 3 |
| Orange / Race 4 | 4 |
| Plum / Race 5 | 5 |
| Biplane | 6 |
Figure 9

| | | |
|---|---|---|
| GetSymbol(0,index[0]) | GetSymbol(1,index[1]+2) | Etc. |
| GetSymbol(0,index[0]+1) | GetSymbol(1,index[1]+2) | Etc. |
| GetSymbol(0,index[0]+2) | GetSymbol(1,index[1]+2) | Etc. |
| Etc. | etc. | |

| | | | |
|---|---|---|---|
| GetSymbol(0,19) | GetSymbol(1,22) | GetSymbol(2,5) | GetSymbol(3,5) |
| GetSymbol(0,20) | GetSymbol(1,23) | GetSymbol(2,6) | GetSymbol(3,0) |
| GetSymbol(0,21) | GetSymbol(1,24) | GetSymbol(2,7) | GetSymbol(3,1) |
| GetSymbol(0,22) | GetSymbol(1,25) | GetSymbol(2,8) | GetSymbol(3,2) |
| GetSymbol(0,23) | GetSymbol(1,26) | GetSymbol(2,9) | GetSymbol(3,3) |

| | | | |
|---|---|---|---|
| 2 | 0 | 5 | 5 |
| 4 | 1 | 2 | 0 |
| 3 | 3 | 3 | 1 |
| 1 | 3 | 5 | 2 |
| 5 | 3 | 6 | 3 |

| Win # | Winning Combination | | | | NumCells | Packed Win # | Award | Bonus |
|---|---|---|---|---|---|---|---|---|
| 0 | Seven | Seven | Seven | - | 3 | 0 | 100 | 0 |
| 1 | Horse Shoe | Horse Shoe | Horse Shoe | - | 3 | 57 | 50 | 0 |
| 2 | Bell | Bell | Bell | - | 3 | 114 | 25 | 0 |
| 3 | Watermelon | Watermelon | Watermelon | - | 3 | 171 | 10 | 0 |
| 4 | Orange | Orange | Orange | - | 3 | 228 | 5 | 0 |
| 5 | Plum | Plum | Plum | - | 3 | 285 | 1 | 0 |
| 6 | Seven | Seven | Biplane | Race 0 | 4 | 42 | 100 | 10 |
| 7 | Horse Shoe | Horse Shoe | Biplane | Race 1 | 4 | 435 | 50 | 10 |
| 8 | Bell | Bell | Biplane | Race 2 | 4 | 828 | 25 | 10 |
| 9 | Watermelon | Watermelon | Biplane | Race 3 | 4 | 1221 | 10 | 10 |
| 10 | Orange | Orange | Biplane | Race 4 | 4 | 1614 | 5 | 10 |
| 11 | Plum | Plum | Biplane | Race 5 | 4 | 2007 | 1 | 10 |
| 12 | Seven | Seven | Biplane | Race 5 | 4 | 47 | 100 | 5 |
| 13 | Horse Shoe | Horse Shoe | Biplane | Race 3 | 4 | 437 | 50 | 5 |
| 14 | Bell | Bell | Biplane | Race 4 | 4 | 830 | 25 | 5 |
| 15 | Watermelon | Watermelon | Biplane | Race 1 | 4 | 1219 | 10 | 5 |
| 16 | Orange | Orange | Biplane | Race 2 | 4 | 1612 | 5 | 5 |
| 17 | Plum | Plum | Biplane | Race 0 | 4 | 2002 | 1 | 5 |
| 18 | Seven | Seven | Biplane | Race 1 | 4 | 43 | 100 | 2 |
| 19 | Horse Shoe | Horse Shoe | Biplane | Race 2 | 4 | 436 | 50 | 2 |
| 20 | Bell | Bell | Biplane | Race 0 | 4 | 826 | 25 | 2 |
| 21 | Watermelon | Watermelon | Biplane | Race 4 | 4 | 1222 | 10 | 2 |
| 22 | Orange | Orange | Biplane | Race 5 | 4 | 1615 | 5 | 2 |
| 23 | Plum | Plum | Biplane | Race 3 | 4 | 2005 | 1 | 2 |
| 24 | Seven | Seven | Biplane | - | 3 | 6 | 100 | 1 |
| 25 | Horse Shoe | Horse Shoe | Biplane | - | 3 | 62 | 50 | 1 |
| 26 | Bell | Bell | Biplane | - | 3 | 118 | 25 | 1 |
| 27 | Watermelon | Watermelon | Biplane | - | 3 | 174 | 10 | 1 |
| 28 | Orange | Orange | Biplane | - | 3 | 230 | 5 | 1 |
| 29 | Plum | Plum | Biplane | - | 3 | 286 | 1 | 1 |
| 30 | - | - | - | - | 0 | 0 | 0 | 0 |

Figure 13

| | Payline[0] | Payline[1] | Payline[2] | Payline[3] | Payline[4] |
|---|---|---|---|---|---|
| Pack dLine[0] | 0 | 0 | 0 | 0 | 0 |
| PackedLine[1] | 2 | 4 | 3 | 1 | 5 |
| PackedLine[2] | 14 | 29 | 24 | 10 | 38 |
| PackedLine[3] | 103 | 205 | 171 | 75 | 272 |
| PackedLine[4] | 726 | 1441 | 1197 | 526 | 1906 |

Figure 14

| | REEL 1 | | REEL 2 | | REEL 3 | | REEL 4 | |
|---|---|---|---|---|---|---|---|---|
| INDEX | SYMBOL | ID | SYMBOL | ID | SYMBOL | ID | SYMBOL | ID |
| 0 | Orange | 4 | Bell | 2 | Orange | 4 | Race 0 | 0 |
| 1 | Watermelon | 3 | Plum | 5 | Horseshoe | 1 | Race 1 | 1 |
| 2 | Horseshoe | 1 | Orange | 4 | Plum | 5 | Race 2 | 2 |
| 3 | Plum | 5 | Horseshoe | 1 | Plum | 5 | Race 3 | 3 |
| 4 | Watermelon | 3 | Plum | 5 | Plum | 6 | Race 4 | 4 |
| 5 | Plum | 5 | Horseshoe | 1 | Plum | 5 | Race 5 | 5 |
| 6 | Bell | 2 | Bell | 2 | Bell | 2 | | |
| 7 | Orange | 4 | Seven | 0 | Watermelon | 3 | | |
| 8 | Plum | 5 | Watermelon | 3 | Plum | 5 | | |
| 9 | Seven | 0 | Orange | 4 | Plane | 6 | | |
| 10 | Orange | 4 | Horseshoe | 1 | Bell | 2 | | |
| 11 | Seven | 0 | Orange | 4 | Seven | 0 | | |
| 12 | Watermelon | 3 | Plum | 5 | Orange | 4 | | |
| 13 | Plum | 5 | Orange | 4 | Watermelon | 3 | | |
| 14 | Horseshoe | 1 | Horseshoe | 1 | Plum | 6 | | |
| 15 | Seven | 0 | Watermelon | 3 | Watermelon | 3 | | |
| 16 | Seven | 0 | Bell | 2 | Seven | 0 | | |
| 17 | Watermelon | 3 | Watermelon | 3 | Bell | 2 | | |
| 18 | Bell | 2 | Seven | 0 | Plum | 5 | | |
| 19 | Bell | 2 | Watermelon | 3 | Plum | 6 | | |
| 20 | Orange | 4 | Plum | 5 | Bell | 2 | | |
| 21 | Watermelon | 3 | Seven | 0 | Seven | 0 | | |
| 22 | Horseshoe | 1 | Seven | 0 | Horseshoe | 1 | | |
| 23 | Plum | 5 | Horseshoe | 1 | Bell | 2 | | |
| 24 | Horseshoe | 1 | Watermelon | 3 | Plum | 6 | | |
| 25 | Orange | 4 | Watermelon | 3 | Watermelon | 3 | | |
| 26 | Seven | 0 | Watermelon | 3 | Watermelon | 3 | | |
| 27 | Bell | 2 | Seven | 0 | Orange | 4 | | |
| 28 | Watermelon | 3 | Horseshoe | 1 | Seven | 0 | | |
| 29 | Horseshoe | 1 | Plum | 5 | Plum | 6 | | |

Figure 15

| Symbol(s) | Symbol ID |
|---|---|
| Seven / Race 0 | 0 |
| Horse Shoe / Race 1 | 1 |
| Bell / Race 2 | 2 |
| Watermelon / Race 3 | 3 |
| Orange / Race 4 | 4 |
| Plum / Race 5 | 5 |
| Biplane | 6 |

Figure 16

| Multiplier | Modulus | Modulus as a P wer f 2 |
|---|---|---|
| 13821 | 32768 | 2^15 |
| 47485 | 65536 | 2^16 |
| 82669 | 131072 | 2^17 |
| 160461 | 262144 | 2^18 |
| 217293 | 524288 | 2^19 |
| 387645 | 1048576 | 2^20 |
| 886269 | 2097152 | 2^21 |
| 2067221 | 4194304 | 2^22 |
| 3513381 | 8388608 | 2^23 |
| 12268885 | 16777216 | 2^24 |
| 21149085 | 33554432 | 2^25 |
| 41430805 | 67108864 | 2^26 |
| 96801245 | 134217728 | 2^27 |
| 169764749 | 268435456 | 2^28 |
| 338335805 | 536870912 | 2^29 |
| 777138309 | 1073741824 | 2^30 |
| 906185749 | 2147483648 | 2^31 |
| 3039177861* | 4294967296* | 2^32* |
| 6223592213 | 8589934592 | 2^33 |
| 10618587253 | 17179869184 | 2^34 |
| 21733031525 | 34359738368 | 2^35 |
| 12132445 | 68719476736 | 2^36 |
| 33531852193 | 137438953472 | 2^37 |
| 85136592465 | 274877906944 | 2^38 |
| 481296297737 | 549755813888 | 2^39 |
| 330169576829 | 1099511627776 | 2^40 |
| 386564843009 | 2199023255552 | 2^41 |
| 3485675500289 | 4398046511104 | 2^42 |
| 812661373313 | 8796093022208 | 2^43 |
| 17007948002497 | 17592186044416 | 2^44 |
| 1561091795041 | 35184372088832 | 2^45 |
| 44485709377909 | 70368744177664 | 2^46 |
| 34155093825977 | 140737488355328 | 2^47 |
| 67884336772053 | 281474976710656 | 2^48 |

Figure 17

| Platforms | Authenticate Executables | Authentic at n Network | Network Access | Netw rk Messag Security | Database Security | Audit | User Access | Installation |
|---|---|---|---|---|---|---|---|---|
| DOS POS | Boot loader | Network Login using Hall Secret | Based on network login access | Broadcast Packet Signed with Session Secret | Rows signed with private key | None | None | When application loads, prompts for certificate request if cannot login |
| Master | Boot loader | N/A | N/A | N/A | N/A | Keystroke Monitor | Console / Network | Generates Hall Secret, Hall private/public key, Request certificate from Gaming CA |
| Caller (if separate) | Boot loader | Network Login using Hall Secret | Based on network login access | Broadcast Packet Signed with Session Secret | Rows signed with private key | None | None | When application loads, prompts for Certificate Request if cannot login |
| COM | Boot loader | Network Login using Hall Secret | Based on network login access | N/A | N/A | None | Dial In | When application loads, prompts for Certificate Request if cannot login |
| Player | Boot loader | Network Login using Hall Secret | Based on network login access | Broadcast Packet Signed with Session Secret | Rows signed with private key | None | None | When application loads, prompts for Certificate Request if cannot login |
| Windows POS | Windows Software Installation Control | Network Login using Hall Secret | Based on network login access | N/A | Rows signed with private key | None | None | When application loads, prompts for Certificate Request if cannot login |
| TED | Subsection Testing | Negotiates Session Secret using Hall Secret at POS | N/A | Signed Data with Session Secret | N/A | None | None | N/A |
| $TED^2C$ | Boot loader | Negotiates Session Secret using Hall Secret at POS | N/A | Signed Data with Session Secret | N/A | None | None | When application loads, prompts for Certificate Request if cannot login |
| Traveler | Boot loader | Negotiates Session Secret using Hall Secret at POS | N/A | Signed Data with Session Secret | N/A | None | None | When application loads, prompts for certificate requests if cannot login |
| Remote Crate | Boot loader | Network Login using Hall Secret | Based on network login access | Packet Signed with Session Secret | Rows signed with private key | None | None | When application loads, prompts for certificate requests if cannot login |
| Non-Gaming | None | Not Authorized | Access not allowed | No Messages Sent | Does not access Gaming Database | None | Unsec. | No special action |

Figure 27

ENHANCED GAMING SYSTEM

This application is related to, and claims priority from, Provisional U.S. Patent Application Ser. No. 60/435,274, filed Dec. 23, 2002, which is incorporated herein by reference in its entirety. This application is also related to, and claims priority from, Provisional U.S. Patent Application Ser. No. 60/501,557, filed Sep. 9, 2003, which is incorporated herein by reference in its entirety. This application is further related to, and claims priority from, Provisional U.S. Patent Application Ser. No. 60/502,675, filed Sep. 15, 2003, which is incorporated herein by reference in its entirety.

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates to the field of gaming, and in particular provides an enhanced gaming system through which a variety of games of skill and/or games of chance can be made available to players in a gaming hall.

BACKGROUND OF THE INVENTION

States face ever-increasing costs just to maintain essential services, but residents are typically unwilling to pay higher taxes to fund these services. Some states have begun to recognize gaming as a potential revenue source which can help generate funds for the state, thereby offsetting the need for increased taxes. For example, most states now sponsor lotteries or the like, the proceeds of which are typically used to fund educational or other programs. In addition, more and more states are legalizing, albeit under heavy regulation, certain other types of gaming, such as slot machines.

One of the first games which is typically legalized by states, especially for non-profit fundraising activities, is bingo. As described in U.S. Pat. No. 5,857,911 to Fioretti ("Fioretti"), the teachings of which are incorporated herein by reference in their entirety, traditional bingo is played with a card, or gaming board, which is typically a five-by-five numerical array, with the centermost location being blank, or "free". Numbered balls, typically between 1 and 75, are placed in a hopper, and balls are chosen at random from the hopper. Players mark their bingo card as the numbers are drawn, and collectively the marks eventually begin to resemble various shapes. For example, in U.S. Pat. No. 6,398,645 to Yoseloff ("Yoseloff"), the teachings of which are incorporated herein by reference in their entirety, the shapes may include an "X", a plus, a "T", a horizontal line, a vertical line, or other alternative shapes. When the marks on a player's scorecard match a pre-defined pattern, the player has a "bingo" and wins the pot for that game.

Although typically associated with fundraisers for churches and other non-profit groups, bingo has become so popular that even some casinos have begun to offer bingo to their patrons. In fact, bingo has become especially popular at tribal casinos. Congress enacted IGRA to regulate gaming operations run by Indian tribes on Indian land. The Act's purpose is to "provide a statutory basis for the operation of gaming by Indian tribes as a means of promoting tribal economic development, self-sufficiency, and strong tribal governments". 25 U.S.C. §2702(1). The IGRA defines class II gaming in relevant part as follows:

(i) the game of chance commonly known as bingo (whether or not electronic, computer, or other technologic aids are used in connection therewith)

(ii) which is played for prizes, including monetary prizes, with cards bearing numbers or other designations (iii) in which the holder of the card covers such numbers or designations when objects, similarly numbered or designated are drawn or electronically determined, and (iv) in which the game is won by the first person covering a previously designated arrangement of numbers or designations on such cards, including (if played in the same location) pull-tabs, lotto, punch boards, tip jars, instant bingo, and other games similar to bingo.

Games that are not within the definition of class H games are class III. See 25 U.S.C. 2703(8). Congress excluded certain forms of gaming from the class II definition:

The term "Class II gaming" does not include:

i) any banking card games, including baccarat, chemind de fer, or blackjack(21), or ii) electronic or electromechanical facsimiles of any game of chance or slot machines of any kind.

This vagueness, particularly with respect to "electronic or electromechanical facsimiles" created a conflict with another gambling statute, the Johnson Act. Congress' 1988 policy behind the IGRA—a civil regulatory statute—was to promote economic development and encourage tribal gaming within tribal jurisdictions by setting up a game classification scheme. However, Congress' policy behind the Johnson Act—a 1950's era criminal statute—was to criminally prohibit the use of "gambling devices." The two statues support diametrically-opposed congressional policies and thus create inherent and irreconcilable conflicts when read together regarding "electronic technology" aids." The Johnson Act is meant to restrict and criminally prohibit gambling. The IGRA is meant to encourage tribal economic development by promoting gambling.

The NIGC (National Indian Gaming Commission) adopted regulations in 1992 that applied the Johnson Act "gambling devices" definition to electronic equipment. Since then, the overwhelming majority of the district and appellate courts and the NIGC have found, however, that Congress intended for the IGRA to impliedly repeal the Johnson Act when considering class II gaming devices utilizing electronic technological aid equipment. In the preamble to the recently revised regulations, the NIGC recognized the hopeless circular reasoning found in its 1992 definitions of "electronic or electronic facsimiles."

The NIGC administers IGRA and regulates tribal gaming. However, the NIGC shares enforcement responsibilities with DOJ. Jurisdiction over criminal violations is vested in the United States Department of Justice, which also assists the Commission by conducting civil litigation on its behalf in federal court.

The NIGC and the DOJ have differed at times on policy choices (and legal definitions) about what constitutes an IGRA class II verses class III electronic aid equipment and whether the Johnson Act should apply to such equipment.

The NIGC's regulations define class II gaming to include:

(A) bingo or lotto (whether or not electronic, computer or other technologic aids are used) when players:

a. Play for prizes with cards bearing numbers or other designations;

b. Cover numbers or designations when objects, similarly numbered or designated, are drawn or electronically determined; and c. Win the game by being the first person to cover a designated pattern on such card;

(B) If played in the same location as bingo, lotto, pull-tabs, punch boards, tip jars, instant bingo, and other games similar to bingo.

IGRA provides that class II games may utilize "electronic, computer, or other technologic aids" 25 U.S.C. 2703(7). The NIGC's recently revised final regulations define a technologic aid as follows:

(C) Electronic, computer or other technologic aid means any machine or device that:
  a. Assists a player or the playing of a game;
  b. Is not an electronic or electromechanical facsimile, and
  c. Is operated in accordance with applicable Federal communications law.

(D) Electronic, computer, or other technologic aids include, but are not limited to machines or devices that:
  a. Broaden the participation levels in a common game;
  b. Facilitate communication between and among gaming sites; or
  c. Allow a player to play a game with or against other players rather than with or against a machine.

(E) Examples of electronic, computer or other technologic aids include pull-tab dispensers and/or readers, telephones, cables, televisions, screens, satellites, bingo blowers, electronic player stations or electronic cards for participants in bingo games.

The NIGC also revised the definition of "electronic or electromechanical facsimile" in its final published rule:

502.8 Electronic or Electromechanical Facsimile

Electronic or electromechanical facsimile means a game played in an electronic or electromechanical format that replicates a game of chance by incorporating all of the characteristics of the game, except when, for bingo, lotto, or other games similar to bingo the electronic or electromechanical format broadens participation by allowing multiple players to play with or against each other rather than with or against a machine.

502.9 Other Games Similar to Bingo.

Other games similar to bingo means any game played in the same location as bingo (as defined in 25 U.S.C. 2703 (7)(a)(i)) constituting a variant on the game of bingo, provided that such a game is not house banked and permits players to compete against each other for a common prize or prizes.

Bingo's increasing popularity has spurred the development of a variety of technological advancements. By way of example, bingo-like slot machines, such as those taught by Yoseloff and U.S. Pat. No. 5,935,002 to Falciglia, the teachings of which are incorporated herein by reference in their entirety, have been suggested. Still others have designed televised and Internet-based bingo games, such as those taught by U.S. Pat. No. 5,951,396 to Tawil; U.S. Pat. No. 6,012,984 to Roseman; U.S. Pat. No. 6,186,892 to Frank et al.; U.S. Pat. No. 6,280,325 to Fisk; U.S. Pat. No. 6,306,038 to Graves et al.; and U.S. Pat. No. 6,354,941 to Miller et al.; the teachings of each of which are incorporated by reference herein in their entirety.

As bingo's popularity continues to increase, bingo halls, casinos, and other gaming halls are increasingly interested in drawing players to, and retaining players already in, a particular gaming hall. One means some gaming halls, and especially tribal casinos, are using to attract and retain players are pull-tab games. Pull-tab games are typically implemented as two-ply laminated paper containing one or more "pull-tabs" comprised of a perforated tab of paper. When peeled back, the pull-tab reveals symbols or numbers related to a game theme. Examples of traditional pull-tab games include U.S. Pat. No. 3,900,219 to D'Amato et al.; and U.S. Pat. No. 4,033,611, to Johnsen.

Pull-tab games typically feature a limited number of play tickets for a given deal or set (e.g., 100 individual tickets in a set or deal). The play tickets are individually sold to players for a fee. A player pulls one or more tabs on the ticket to determine if the player is a winner. Although typically designed as instant-win games, some pull-tab games provide qualifying symbols for entry into one or more award level rounds associated with the particular deal set. In such an embodiment, once all tickets for a given deal set are sold, those players holding a ticket eligible for the award level round are entered into a secondary game. Typically, this involves the game operator opening a special pull-tab card to reveal the award level round winners. These multi-level games are typically implemented with progressive jackpots to further enhance excitement. U.S. Pat. No. 6,390,916 to Brown discloses a seal card game scheme which includes a plan for multiple levels of non-progressive play. The Brown game card scheme awards a master case award to a winning ticket not among the deal winners. According to Brown, the non-progressive scheme retains the interest of players throughout the deals because everyone retains a chance of winning the case award.

Pull-tab games can help boost gaming hall revenues by helping attract and retain players. However, the paper pull-tab games of the prior art and are not convenient, efficient, or interactive, thus limiting their attractiveness to players, and consequently bingo halls, casinos, and other gaming halls.

The desire to further increase gaming hall revenues has lead to the development of electronic systems for rolling out instant-win, pull-tab game systems, such as those taught in U.S. Pat. No. 5,324,035, to Morris; U.S. Pat. No. 5,871,398 to Schneier et al.; and Published U.S. Patent Application No. 2002/0098882 to Lind et al., the teachings of each of which an incorporated herein by reference in their entirety. These game systems allow players to play electronic versions of pull-tab games at specially programmed player terminals. Such terminals can be handheld units, such as the TED and Traveler lines of handheld gaming units manufactured by GameTech International, Inc., the assignee hereof, or fixed base station units, thereby allowing such game systems to be implemented in a wide variety of environments. Although the Lind, Schneier, and Morris game systems represent a progression in the art over paper pull-tab distribution devices such as that taught in U.S. Pat. No. 5,348,299, to Clapper et al., the teachings of which are incorporated herein by reference in their entirety, the game systems still have limitations. For example, although the game systems allow a variety of pull-tab based games to be played, the systems do not allow players to participate in alternative types of games, or to simultaneously play a variety of games of differing types.

In addition, the technological advances represented by the various references can have a down-side. As recently experienced when a horse race betting system designed by Autotote, Inc. of Wilmington, Del., was compromised, computerized gaming systems can be alluring targets for those seeking to get rich illegally. Part of the allure of computerized gaming systems is that it can be harder to detect when a system has been compromised and to trace all of the parties involved than with traditional game systems. Some in the prior art have attempted to implement more secure gaming systems. For example, U.S. Pat. No. 6,149,522, to Alcorn et al., teaches a method of authenticating game datasets in an electronic casino gaming system.

SUMMARY OF THE INVENTION

What is needed is an enhanced gaming system which allows players to participate in pull-tab, bingo, and other games through player terminals or other electronic devices in a secure and protected manner. Accordingly, the present invention is directed to an electronic gaming system that substantially obviates one or more of the problems due to limitations and disadvantages of the prior art.

The gaming system provides a secure computer network architecture through which a variety of games of skill and/or games of chance can be made available to players. The gaming system creates an initial trust across a network and locks down the system once that trust is created. The gaming system advantageously utilizes the fact that after initial trust has been made and the system is locked down, there is virtually no way to place invalid or unwanted software or related files on any PC or other unit on the network without physically opening one or more units.

Clearly, physical access to units should be restricted, otherwise the software within a given unit is at risk. However, because of the software and game integrity protections implemented as part of the gaming system, compromise of a given unit will not typically result in a compromise of the game as a whole. Aspects of the gaming system can help prevent unauthorized users from tampering with data that resides on a Master computer and to detect such tampering should it take place. In accordance with a preferred gaming system architecture, game integrity is maintained and preserved within Master computer data, and thus the compromise of an individual gaming unit has no effect on the outcome of, nor can it cause a compromise of, a game.

As part of the software protections implemented in the gaming system, all software and related files that are run or installed on any server, Master computer, individual gaming station, or other unit in the network should be digitally signed, digitally authenticated, or otherwise verified prior to use. Cryptography can also be used within the gaming system to ensure communication between units on the gaming system is not improperly intercepted, tampered with, or other wise improperly used.

A preferred gaming system embodiment implements a Public Key Infrastructure (PKI) within the gaming system, with each authorized user and gaming system unit being assigned a unique public/private key pair and a digital certificate from a Certificate Authority (CA). A PKI is a security infrastructure based upon public key cryptography. A PKI is defined by the PKIX Working Group as the set of hardware, software, people and procedures needed to create, manage, store, distribute and revoke digital certificates based on public-key cryptography. Such gaming system embodiments preferably include at least one Certificate Authority and/or Registration Authority (RA), which manage digital certificates used within the gaming system.

In a preferred embodiment, digital executable and related file authentication can be implemented as a digital data file whose content is based on the private key of the sender and the content of the executable or related file. By way of example, without intending to limit the present invention, a known good source to create a unique pair of private and public keys. The private key is preferably kept private while the public key is stored in all units at a gaming hall. Digitally authenticated executables can then be created by RSA-CBC-mode encrypting the executable and a concatenated identification string with the private key.

At the gaming halls, the gaming system will preferably verify the digitally authenticated executables and related files by first decrypting the encrypted executables and related files with the corresponding public key. The gaming system can then search for and identify the concatenated identification string with the decrypted executables for verifying that the received executables are authentic.

Digital authentication is preferably enforced at the operating system level by configuring the operating system to only allow applications and other files which have been digitally authenticated to be loaded and/or run. Digital authentication is preferably enforced at the Boot Loader level. In a preferred digital authentication embodiment, a known good source encrypts software and related files using its private key. The encrypted files are then transmitted to the Master computer, where they are stored for use. By so doing, the register computer effectively becomes the known good service for the local aspects of the gaming system. A Boot Loader installed on the Master computer decrypts the stored software or related file using the known good source's public key and, assuming the decryption is successful, the Boot Loader allows the files to be loaded and run. If decryption is unsuccessful, the Boot Loader can force a retransmission of all files, or those files whose decryption failed. In an alternative embodiment, the gaming system may utilize a hash-based authentication scheme similar to that taught in U.S. Pat. No. 6,149,522, to Alcorn et al., the teachings of which are incorporated herein in their entirety.

Additional security measures may also be implemented in a preferred embodiment, although one skilled in the art should appreciate that these additional security measures are optional. Given the high level of security inherent in the overall gaming system architecture, these additional security measures may not increase the level of security in the gaming system enough to warrant their costs; however, some jurisdictions require such additional security methods, and the gaming system is preferably configured to support the implementation of such additional security methods. Such additional security methods include, but are not limited to:

Hardware read-only Boot Loader modules—these modules give a certain level of security because they prevent the boot process from being affected unless a unit has been physically compromised;

Modified PC BIOS that authenticates a Boot Loader;

Locked PCs and/or cabinets—This makes a physical attack more difficult;

Tamper Evident Tape—Placing this on all PC's allows intrusion detection. While tamper evident tape does not prevent units from being physically compromised, the use of such tape does allows physical compromise to be detected; and Bingo Card Starts & Distribution Server (Black-Box)—When used, this feature adds a significant level of security for any game cards that are in play for a given game.

All databases implemented in the gaming system are preferably transactional, meaning tracks any data changes are logged, thereby preventing anyone from tampering with the data without leaving an audit trail and without causing notifications to be issued.

The gaming system provides an electronic means for making a variety of games available to players. Although the gaming system utilizes an electronic game and game outcome distribution means, the gaming system is preferably not limited to purely electronic game play. For example, pull-tab games provided under the game system may be played on a gaming unit, and the gaming system also preferably makes pull-tab games available in traditional paper form. Furthermore, the electronic aspects of the gaming system are not limited to presenting game outcomes in a specific format or using a specific set of indicia. By way of example, without intending to limit the gaming system, pull-tab game outcomes may be used to generate slot machine like games.

An object of the gaming system is to minimize the memory used to store large sets of game outcomes. Another object of the gaming system is to minimize the size of messages sent between a Master server and a gaming unit when tickets are played. A main motivation for such minimization is the desire to reduce the amount of memory needed in game units, such as player units or portable units. Another motivation is the desire to limit the overall bandwidth requirements of the gaming system. However, as should be apparent to one skilled in the art, as memory prices continue to fall, and as bandwidth increases, such minimization may not be as necessary.

Due to regulatory restrictions, another object of the gaming system is to avoid using a random number generator to determine which ticket or set of tickets is to be sold in a particular transaction. As should be appreciated by one skilled in the art, in the event random number generators are acceptable in a particular regulatory environment, such random number generators can be substituted for the alternative techniques described herein without departing from the spirit or the scope of the gaming system or its equivalents.

The gaming system described herein preferably allows:

representation of complex, multi-denomination game outcomes as sets of simultaneously open, single-denomination fixed-line eTab decks;

definition of very large game outcome sets, wherein each game outcome is unique to a specific ticket number;

definition of a relatively small set of indicia to be used in a given game;

rapid generation of symbol combinations from ticket numbers using each digit of a multi-base numeric representation of the ticket number as an index into pre-defined reels or other game outcome representations;

generation of an apparently random ticket order using a few constants as inputs into a linear congruential shuffle algorithm, whereby the next ticket to be used can be quickly determined at any point; and, rapid checking of generated game outcomes for winning game outcome combinations by packing the game outcome combinations of each payline into a single, unique packed line number and comparing these with a list of pre-packed win numbers.

The gaming system represents a unique approach to distributing and playing electronic and paper-based games of skill and/or games of chance, including, but not limited to, bingo, pull-tabs, lotto, keno, video poker, slot machine-like games, and the like. The gaming system preferably provides players with faster and more exciting ways to play a game or set of games, operators with a more cost-effective approach than having to load deals of paper pull-tabs into pull-tab dispensers, and regulators with a solution that meets the current interpretation of NIGC Class II regulations.

Electronic game distribution assists players by increasing the speed of the game, minimizing paper elements that slow players' competition and hinders participation between gaming sites, facilitating communication between and among gaming sites, and allowing players to better compete with each other to obtain prizes from the finite pull-tab pool.

Game deals can be altered, prior to opening a deal, to meet customer demands. Such alterations could include, but are not limited to, having different prices, altering the number of tickets purchased, the payout percentage, the win ratios, and different win tiers. By way of example, without intending to limit the gaming system, this flexibility can allow a gaming hall to run some games with a greater number of large prize winners and some with a smaller number of large prizes but a greater number of total prizes overall.

When pre-determined game outcomes are used by the game or games being played on the gaming system, such as in a pull-tab game, a master server preferably reads and distributes such pre-determined game outcomes to game play units as such outcomes are requested by players. The master server also preferably stores records of the distributed game outcomes as game play records. Players may obtain and view game outcomes in a wholly electronic format. Players may also obtain paper-based game outcome representations. Paper game outcomes may be obtained by requesting a printed receipt of each electronic pull-tab played by the player. Such receipts may be obtained at a POS unit, also referred to herein as an AllTrak, by presenting a player's unique electronic game card or other player-specific identifier. The paper game outcomes can be validated against pre-determined pull-tab play results contained in a paper compilation of each pull-tab play, and players may see pull-tab game results in many places throughout the tribal casino using a video display verification system ("video verifiers"). Such video verifiers simply demonstrate the pre-determined game outcomes with exciting graphic displays. The video verifiers are preferably not necessary to the play of the game and in no way affect the pre-determined outcome of the game. In fact, an individual player may play a game at a POS unit without the use of the video verifiers at all. Players always have the option to review, to obtain, and to retain paper tabs evidencing their play.

The gaming system can allow games to be played in a "demonstration mode". The demonstration mode preferably allows players to play games for fun only and to learn how to interact with gaming units that are part of the gaming system. The demonstrations can also be forwarded to hall operators electronically or on CDs, thereby allowing a hall operator to demonstrate and simulate a complete game. Such demonstrations preferably include all form numbers, name, price, count, number of tab windows, gross profit, payout percentage, win ratio and a description of all prize tiers.

The gaming system also preferably allows invoices to be automatically generated on a weekly, monthly, or other time increment, such that the gaming system manufacturer or underwriter can properly bill a gaming system operator. Such invoices may contain: date of sale; quantity of eTabs sold; cost per eTab sold; serial number of each eTab deal; and the name and address of the purchaser.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

In the drawings:

FIG. 7 is a block diagram illustrating the use of abstraction to represent a multi-line, multi-denomination game.

FIG. 8 is a block diagram illustrating symbol display location indices for a multi-line game.

FIG. 9 is a table of indicia and corresponding Symbol IDs.

FIG. 13 is a WinCombos Definition table for Barnstorm Bonus.

FIG. 14 is a Packed Line Numbers table for Ticket Number 106595.

FIG. 15 is a Reel Definition table for a Barnstorm Bonus game.

FIG. 16 is a table of indicia and corresponding Symbol IDs.

FIG. 17 is a table of multipliers, moduluses, and expressions of the moduluses as a power of two.

FIG. 27 is a table enumerating some of the various unit types preferably supported by a gaming system and the security measures preferably implemented thereon.

DETAILED DESCRIPTION OF THE PREFERRED EMBODIMENT

Reference will now be made in detail to preferred gaming system embodiments, examples of which are illustrated in the accompanying drawings. Although reference is made to individual embodiments, it should be apparent to one skilled in the art that concepts or features discussed with respect to one embodiment can be applied to other embodiments without departing from the spirit or the scope of the invention.

Figure 1:
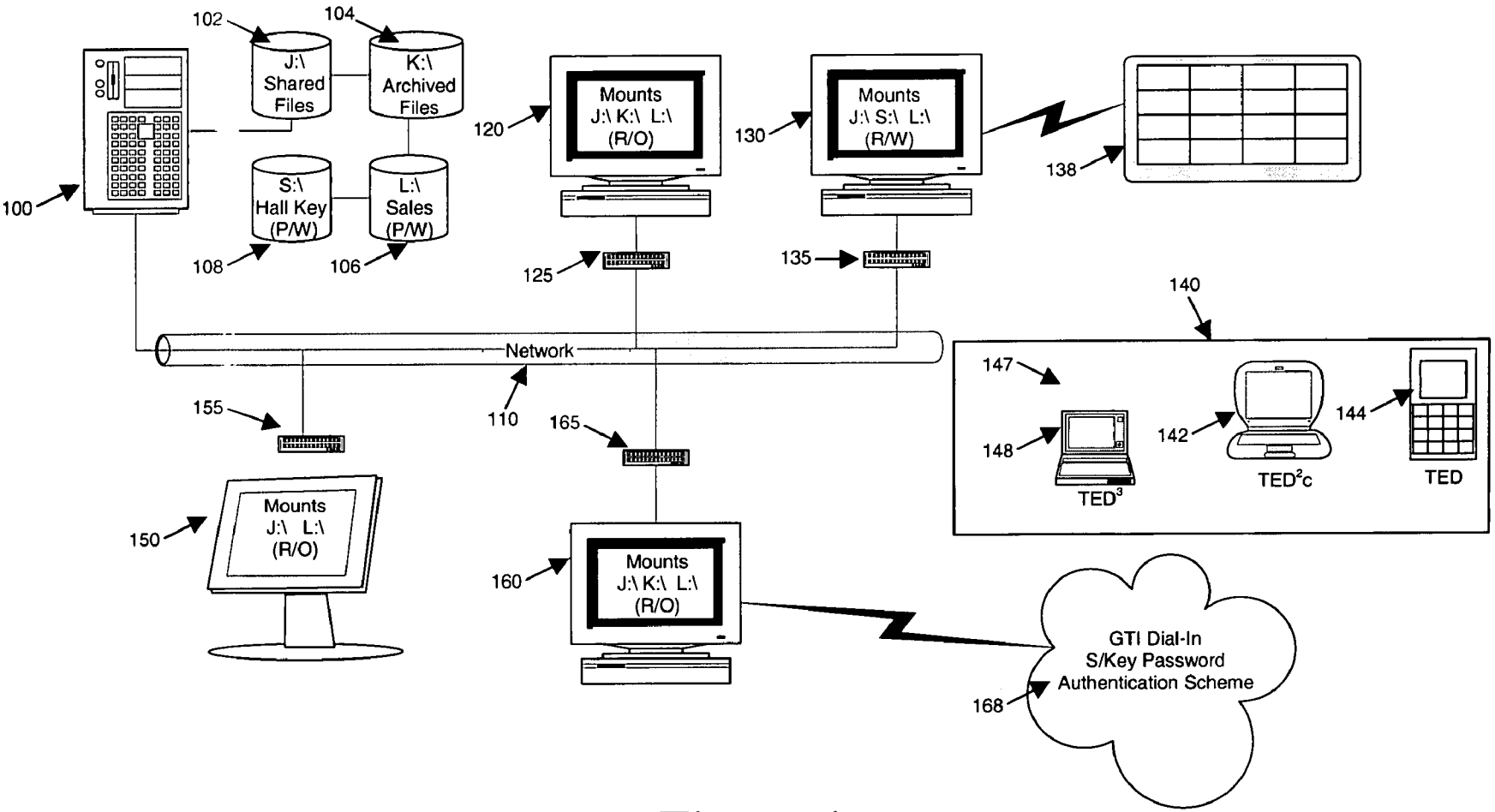
FIG. 1 is a functional block diagram providing an overview of a typical hall-level network according to the gaming system, and the interaction and interrelationship of the components thereof.

In the embodiment illustrated in FIG. 1, the gaming system preferably establishes a verifiable relationship among the various units connected to Network 110. This verifiable relationship is preferably implemented during initial installation and continues unbroken until the system is removed. The verifiable relationship may include establishing one or more CA's, as defined by the PKIX Working Group, and issuing certificates to various units as described in RFC3280, published by the Internet Engineering Taskforce. During initial installation, a technician preferably builds the network and installs the various units needed for the environment in which the gaming system is to be deployed. By way of example, without intending to limit the gaming system, the units illustrated in FIG. 1, including Master 100, Point of Sale (POS) units 130, caller 120, Player Units 150, portable units 140, and Communications Unit (COM Unit) 160, can be used to distribute and play games of chance, including games with predetermined outcomes like pull-tab games and video poker; random chance games, such as lotteries, bingo, and slot machines; and games of skill, such as trivia games and puzzles. The preceding list is intended to be exemplary and should not be construed as limiting the gaming system. Furthermore, it should be apparent to one skilled in the art that the gaming system may provide subsets of the available games to different player terminals based on gaming hall preferences, player demand, or other such criteria.

Once secure network operations have been properly validated, the technician preferably shuts down the various units to prevent unauthorized activities from taking place during this critical stage, although Master 100 may optionally stay powered on. In the embodiment illustrated in FIG. 1, Master 100 is preferably implemented as a DOS-based server running the LANtastic series of applications distributed by SpartaCom Technologies, Inc. of Tucson, Ariz. The LANtastic applications can be useful because of security options provided thereby. While DOS-based Master 100 servers may be used to implement the gaming system, those skilled in the art should appreciate that alternative software may be substituted therefor, and that the operating system may be enhanced to provide additional security features, without departing from the spirit or the scope of the gaming system taught herein or its equivalents. Still further, although the features and functions of Master 100, also referred to herein as a Bingo Gaming Components server or BGC server, are described herein as being performed by a single Master server, it should be apparent to one skilled in the art that responsibility for providing such features and functions may be distributed across multiple servers without departing from the spirit or the scope of the gaming system or its equivalents.

In the embodiment illustrated in FIG. 1, Master 100 preferably includes at least one local drive and at least four network accessible Drives 102 through 108. Each of Drives 102 through 108 may constitute a single physical drive; multiple physical drives acting as a single drive, as in a Redundant Array of Independent Disks (RAID) array; or a "virtual drive" or partition on one or more physical drives. Presently, implementing each drive as separate physical drives is preferred because it is less expensive than using a RAID array and provides more security than simply partitioning a single drive. Master 100 uses each of drives 102 through 108 and the local drive to store different types of data.

It should be apparent to one skilled in the art that alternative data access and data storage means may be implemented within the gaming system without departing from the spirit or the scope hereof. By way of example, without intending to limit the gaming system, drives can be used in the more virtual sense, in that a drive is simply the exposure of data to a unit or group of units in the system. This may include exposing partitions, folders, files, databases, or programming API's to allow the units to gain access to data and/or functions provided by Master 100. In such an embodiment, data access restrictions can be imposed via a server application running on Master 100. A server application can expose data to authenticated users of the system via network messages, requests from network clients, or other such means. This architecture is commonly referred to as a Client/Server topology, and implementation of such a topology is well known in the art.

Referring again to the embodiment illustrated in FIG. 1, Master 100 preferably includes a local drive, referred to as the "C" drive, which is preferably not network accessible. Private, unshared information can be placed on this drive, such as Local Applications and the Hall Private Code which are described below.

Drive 102, also referred to as the "J" drive, preferably stores files to be shared among the various units of the invention, such as game indicia. By default, validated users may have read and write access to Drive 102. Software stored on Drive 102 should preferably be digitally signed utilizing RSA Laboratories PKCS#7 standard, which is well known in the art, or other similar packaging means.

Drive 104, also referred to as the "K" drive, preferably stores archived files, including logs from previously played games. By default, validated users will have read and write access to Drive 104. Files stored on Drive 104 may be compressed using ZIP, RAR, or other encryptable data compression techniques.

Drive 106, also referred to as the "L" drive, stores sales data such as, but not limited to, bingo cards, eTab tickets, games of skill credits, or the like sold by POS units 130. Access to Drive 106 is limited to specific users based on their username and password and the unit from which they are accessing the drive. By default, authorized, validated users may only read from Drive 106 when Drive 106 is being accessed from POS 130, in which case the user may read and write to Drive 106.

Each sales record stored on Drive 106 preferably contains an HMAC-SHA1 hash signature encoded with the Hall Private Code and the Group Embedded Secret (described below) or other digitally authenticable form of such data. Each sales record also preferably contains a unique sequential transaction number included within the authentication information. Further, the last record in the sales transaction table is preferably flagged, thereby preventing records from being added without modifying an authenticated record. Each sales record is also preferably tagged with the current POS 130 software version number. This allows an accounting department to properly validate sales information when used in conjunction with the Hall Private Code.

Through this architecture, a player or user wishing to modify a record would need access to the Hall Private Code and the current POS software version's SecureGroup Embedded Secret, and would have to gain access to the Hall's unique login and password to gain read/write access to the data, the combination of which would be difficult to achieve without being detected. In addition, records may also be digitally signed or digitally authenticated, such as by using a unique user private key to encrypt the data and the identification string and verify the data by decrypting the data and identifying the identification string.

If desired by the gaming hall, a game card distribution database can be stored on Drive 106. The game card distribution database is preferably secured by creating a hash value using the Hall Private Code and the Secure Group Embedded Secret. A game card distribution database preferably stores the game card information for each game and sale, and can be used by Caller 120 for game card verification. As used herein, the term game card is intended to connote one or more opportunities to participate in a game or games provided by the gaming system. By way of example without intending to limit the gaming system, a game card may include a bingo card, a plurality of eTabs chances, a lottery number, and three opportunities to play a trivia game.

Drive 108, also referred to as the "S" drive, preferably stores security keys for the physical site at which the gaming system is installed (referred to as a "gaming hall"). Access to Drive 108 is limited to specific users based on their username and password and the unit from which they are accessing the drive. By default, authorized, validated users may only read from Drive 108 if Drive 108 is being accessed by an authorized, validated user from POS 130 or Caller 120. All other attempts to access Drive 108 should be denied.

Master 100 preferably also runs the Diamond Server application suite. Although initially anticipated to provide specific security-related functionality, the Diamond Server application suite is expected to expand over time to include additional capabilities. Such capabilities may include, but are not limited to, facilitating a client/server based architecture in which data is exposed via API's as opposed to direct file access. In the presently preferred embodiment, the Diamond Server application server is first used by a technician during network installation to generate a Hall Private Code, which is stored temporarily on Drive 108 until the installation process is complete. Hall Private Codes are codes unique to a gaming hall that are used to identify data associated with the gaming hall. Hall Private Codes are also used in conjunction with a Group Embedded Secret to generate HMAC-SHA1 values for the sales file records and the like.

Hall Private Codes are preferably between at least 168 bits of random data, with the overall code length also random. A Hall Private Code will preferably stay the same at each hall indefinitely, only changing when or if it is considered compromised. A Hall Private Code is preferably transferred to and stored locally by COM 160, POS 130, and Caller 120 units during initial installation, as will be described below. Storing the Hall Private Code locally on these units prevents the code from being transmitted over the network except during the first installation, effectively making the Hall Private Code only vulnerable to physical attack, because the local data is not network-accessible. Once the appropriate units have stored the Hall Private Code, it is removed from Drive 108.

A Group Embedded Secret is random data, of a length preferably chosen at random but greater than 168 bits, which is stored within software associated with the gaming system. A Group Embedded Secret is used to generate HMAC-SHA1 values for various data to encrypt files, and for other digital authentication purposes. A Group Embedded Secret can also be used in conjunction with a Hall Private Code by units in the Secure Group, defined below, to authenticate records or data within the system via HMAC-SHA1. In addition, Group Embedded Secrets can be used to generate challenge/response codes to validate that current software versions are installed on the units, and that the correct software is running during game play and when a game is won.

Units in the network are preferably divided into two groups, the User Group, typically consisting of Player Units 150, Portable Units 140, and Master 100; and the Secure Group, typically consisting of Caller 120, POS 130, COM 160, and Master 100. The Group Embedded Secret is preferably different among the groups, with only Master 100 knowing all of the Group Embedded Secrets. Group Embedded Secrets will preferably change with each software release, thus preventing users from attempting to take advantage of any information gleaned from older software versions.

Once Master 100 is properly configured and the Hall Private Code has been generated, the technician preferably installs Boot Loaders 125, 135, 155, and 165 in the appropriate units. As will be discussed throughout this specification, unit types include, but are not limited to POS units 130, Caller units 120, COM Units 160, Player Units 150, and portable units 140. It should be appreciated by one skilled in the art that although the above-described unit types accurately characterize units employed in the gaming system embodiment illustrated in FIG. 1, alternative unit classification schemes may be used without departing from the spirit or the scope of the invention.

In the embodiment illustrated in FIG. 1, each unit type may require specific Boot Loader software to be associated with the Boot Loader, such as, but not limited to, loading such software onto a computer chip which is communicatively coupled to the Boot Loader. Once any software has been associated with the Boot Loader, security tape may be applied to the Boot Loader or components thereof to make tampering more evident, or other tamper-evident means may be employed. A Boot Loader may also reside in a BIOS chip on a motherboard or operate in combination with the BIOS. Where a Boot Loader is used in combination with the BIOS, the BIOS preferably validates the authenticity of the Boot Loader before booting from it. This can be done via a standard MD5 hash, via a digital signature of the data residing on the Boot Loader, via encryption of the data residing on the Boot Loader, or through other digital authentication means.

Figure 2:
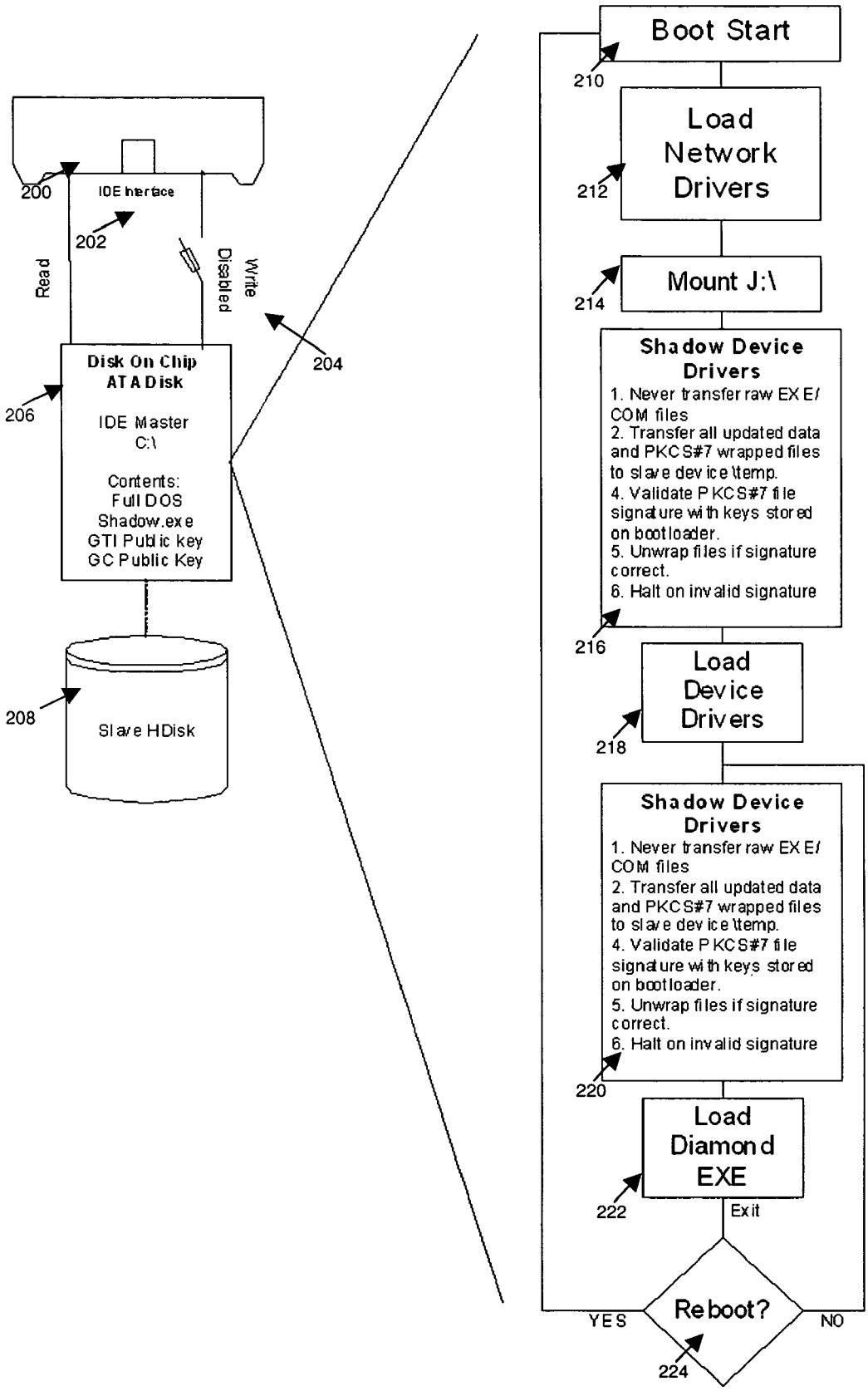
FIG. 2 is a flow chart illustrating preferred Boot Loader operation.

FIG. 2 is a block diagram illustrating a Boot Loader embodiment. As illustrated in FIG. 2, each Boot Loader may be configured with appropriate public keys. This may result in different Boot Loaders for different jurisdictions to accommodate different Gaming Commission ("GC") Public Keys. In the embodiment illustrated by FIGS. 1 and 2, Boot Loaders may be installed on all units except Master 100. The Boot Loader illustrated in FIG. 2 can be associated with PC-based units of the gaming system embodiment of FIG. 1, including, but not limited to Player Units 150, portable units 140, COM 160, Caller 120, and POS 130.

In the embodiment illustrated in FIGS. 1 and 2, as part of Block 212 of FIG. 2, Boot Loaders 125 and 135 may not only overwrite software installed on Caller 120 and POS 130, respectively, but they may also impose additional security restraints by requiring a user to enter a valid username and password before Caller 120 and/or POS 130 is allowed to boot. To perform username/password authentication during boot up, each unit preferably prompts the user for the appropriate information. The data the user enters can be validated against a user/password database stored within the Boot Loader. The Boot Loader can then determine whether a connection can properly be made (Block 214). If not, the Boot Loader will allow up to three retries, then the Boot Loader will preferably lock for a random period of time not less than 30 minutes. Although a local username/password database is contemplated, it should be apparent to one skilled in the art that network-based authentication can be substituted therefor without departing from the spirit or the scope of the gaming system or its equivalents.

As FIG. 2 further illustrates, Boot Loaders preferably include a GTI Public Key and a GC Public Key (if one is required by the jurisdiction). The GTI Public/Private Key Pairs are preferably generated by a secure hardware signing device. This device is preferably maintained at a central office or compliance department associated with the manufacturer of the gaming system. GTI keys are used to digitally authenticate software and any related files so that they may be recognized as authentic and originating from the manufacturer.

GC Public/Private Key Pairs are also keys generated by a secure hardware signing device, however such keys are typically generated by a device controlled and/or maintained by the regulatory body for the jurisdiction into which the gaming system is installed. In a preferred embodiment, neither the device nor the internal private key are kept by or are accessible to the manufacturer of the gaming system, although the public key is preferably given to the manufacturer to be distributed with the gaming system.

As with the GTI Public keys, GC Public Keys can digitally authenticate software and related files. Examples of such related files include, but are not limited to, INI, or initialization, files which control or influence a unit during the boot process game software, and game indicia. In a preferred embodiment, any jurisdictionally regulated settings can be placed in an INI file. This file must be digitally authenticated with the GTI Public Key and the GC Public Key. For jurisdictions requiring INI files, gaming software will not be allowed to run if authentication fails. Such constraints will prevent unauthorized persons from editing the INI file. If there is no need in a given jurisdiction to lock down the INI file with digital authentication, then the INI file can be edited and digitally authenticated at the manufacturer's corporate office. Otherwise, any changes will need to be authorized by the jurisdictional authorities.

In the embodiment illustrated in FIG. 1, when the Boot Loader has been installed, each unit is brought up long enough for the technician to test that the Boot Loader has been properly installed. The Diamond Server application suite preferably archives data from POS 130, Caller 120, COM Unit 160, and other data transmitted across the network to Drive 104, including challenge response data transmitted during unit boot time. In an alternative embodiment, if the system is to be configured without Boot Loaders, then the data on the hard drive or other mass storage means can simply be replaced with a known good image.

Preferably, after each unit has been tested and operationally verified, the BIOS settings are recorded and a BIOS password set to prevent tampering. Master 100 is then placed in Registration Mode. When Master 100 is placed in Registration Mode, special "cleaning" software is placed in Drive 102. This cleaning software is configured to remove any gaming files from the unit on which it is run, thus ensuring that the unit will run the latest version of the gaming files without the possibility that old files will remain in the gaming system. Registration Mode also causes Master 100 to begin listening for unit registration requests. Once Master 100 is in Registration Mode, each unit on the network is powered on, preferably one at a time.

Ordinarily, as the units come up, the Boot Loader associated with that unit would download software from Drive 102 of Master 100 which is appropriate to the unit's function, validate the software using the appropriate public keys and other security features, and cause the unit to run the software. However, because Master 100 is in Registration Mode, cleaning software is downloaded and run by the units instead. In addition to deleting gaming software and related files from each unit, the cleaning software preferably registers the unit with Master 100. The Media Access Control (MAC) address(es) for the unit and/or other unique unit identifiers are preferably included in the Master 100 registration information sent to Master 100.

In the embodiment of FIG. 1, as Master 100 receives registration information, it also preferably initiates a challenge response generation. As described below, challenge response generation ordinarily occurs at regular intervals, but placing Master 100 in Registration Mode preferably forces challenge response generation to begin. During challenge response generation, the Diamond Server application suite preferably creates challenge and response databases for each unit or unit type in the system. The challenges are preferably randomized each time challenge response generation is initiated. All units on the network are required to register by including the correct response to the challenge provided for that unit, preferably derived from and/or encoded with shared secrets embedded within the application, current date, time, software version, and MAC address.

In the embodiment of FIG. 1, the challenge database is preferably created on Drive 106 for Player Units, 150 and portable units 140. Drive 106 is preferably is Read-Only to Player Units 150 and portable units 140. The response from a given unit is preferably written to Drive 102. For POS 130, COM 160 and Caller 120, the challenge is written to Drive 108. Drive 108 is read-only to those units. The response is again written to Drive 102. This creates the challenge databases on Drives 106 and 108, and allows the units to respond on Drive 102. An alternative embodiment may employ a client/server architecture, such as that provided by the Diamond System application suite, to handle unit registration rather than employing the drive-based architecture described above.

Once the units have registered with Master 100, Master 100 is taken out of Registration Mode. By taking Master 100 out of Registration Mode, Master 100 replaces the cleaning software with master copies of the latest versions of the gaming software and related files from the local drive.

In the embodiment of FIG. 1, when Master 100 has finished copying the gaming software and related files, the units are rebooted. This causes the software on each unit's Boot Loader to retrieve the latest gaming software and related files from Drive 102. Once the gaming software and related files are transferred, the gaming software and related files are preferably digitally authenticated. The Boot Loader then responds to a challenge from Master 100 and allows the unit to boot as normal, including causing the gaming software to execute. The technician can preferably observe all challenge responses using the Diamond Server application suite to verify that all units are operating properly.

The Diamond Server application suite also preferably generates challenges and monitors responses for each unit in the gaming system at predefined intervals. Examples of such intervals include, but are not limited to, the start of each day, the beginning of a game, when a game has been won, at the expiration of a certain period of time, or after a certain number of games have been played. Response information, and especially incorrect responses, may be transmitted to a technician for further evaluation.

Updates to the gaming software and related files require less effort than initial gaming system installation. Due to the architecture described above, any software updates are simply installed on Master 100, and the units are rebooted. By rebooting the units, the Boot Loaders force the units to download the update.

As described above, there are several unit types associated with the gaming system embodiment illustrated in FIG. 1. The unit types and their operation will be described from the perspective of a typical game in a bingo-based embodiment. Games first start with the sale of one or more game cards by POS 130. POS 130 is a point of sale station on which a Boot Loader has preferably been installed. If a Boot Loader is not installed, a GTI Public Key and GC Public Key should be copied to the POS 130 boot device. In addition, as described above, the Hall Private Code is copied to POS 130 local drive during installation, and the Secure Group Shared Secret is embedded within the software installed on POS 130.

POS 130 will typically require a user to enter a username and password before it establishes any network or local connections. Once a user has entered a valid username and password, POS 130 can connect to Drives 102, 104, and 106 of Master 100. If an invalid username or password is entered, POS 130 will not function, and sales cannot be made.

Each gaming hall employee or other user in the system may be given a unique private key/public key pair. The private key is encrypted with the user's password. The system may use this private key to digitally authenticate data that is generated or altered by the user. Since the private key is encrypted with the user's password, only that user is capable of using the private key to digitally authenticate data. User private keys may also be stored on one or more "smart-cards" or similar devices, and other user authentication means, such as, but not limited to, biometric user authentication devices, may also be employed to further enhance security. This process makes it difficult for users to refute that they were the creator or modifier of data.

POS 130 is preferably capable of distributing individual game cards, or packs of game cards. Depending upon the deal configuration and jurisdictional parameters a game card deal may be opened manually by POS attendant as needed or automatically by the gaming system. For opening manual game card deals, the number of game cards, price of each game card, definite payout, definite profit, and win ratio are preferably shown at POS terminal 131, 141 screens. The information is preferably stored in a database table. For automatic deal opens the number of game cards, price of game cards, definite payout, definite profit, and win ratio are stored in a database table. A deal report will be made available on the system. The gaming system may also include a centrally triggered disable function should a gaming hall have payment problems. Software will enable the operator to bill players for each game card purchased.

Game cards may be distributed in printed or electronic form. Printed game cards may include a bar code or other machine-readable identifier which can be used to automate entering the pack number, or transaction number, from which the game card was issued. Such a pack number may be linked to a variety of information within POS 130, including, but not limited to, remaining player credits, player name, player photograph, player identification number, starting bingo card number, number of bingo cards purchased, and the like.

Electronic game cards distributed by POS 130 may be used by handheld computers, such as the Compaq iPAQ, manufactured by Hewlett Packard, the Treo, manufactured by Handspring, or other portable units 148, 142, and 144, as well as Player Units 150, to participate in games playable on the gaming system.

POS 130 may distribute electronic game cards as a data file or set of data files which can be loaded by software on a particular unit. Electronic game cards are preferably digitally authenticated, and the GTI and/or GC keys associated therewith are validated by POS 130 prior to allowing a unit to download the game cards. Where a unit is capable of validating electronic game cards through digital authentication, a digitally authenticated copy is sent to the unit, and the unit preferably verifies that the game cards are valid. If the unit does not support digital authentication, POS 130 may unwrap and digitally authenticate the game cards prior to transferring them to the unit.

In the embodiment illustrated in FIG. 1, any attempt by a portable unit owner or other player to purchase electronic game cards results in POS 130 verifying the version of any software installed on the portable unit, including performing an MD5 hash, HMAC-SHA1 hash, or digital authentication of one or more random portions of any executable files, prior to sale. Game cards may not be sold to a unit if the installed software version is not correct. POS 130 may learn the correct software version information from the INI file, which is preferably downloaded by the Boot Loader as part of the POS 130 software download. If the system is not configured with a Card/Starts Server, described below, POS 130 can log game card sales to a Virtual Black Box card distribution database and sign the database with the Hall Private Code and the Secure Embedded Secrets with an HMAC-SHA1 hash, or otherwise digitally authenticate the database.

Alternatively, the system may be configured with a Card/Starts Server. A Card/Starts Server is preferably a secure hardware device which provides only limited interface capabilities. By way of example, without intending to limit the gaming system, a Card/Starts Server may only provide a power plug and a network outlet. Any attempts to interface with the Card/Starts Server would therefore be subject to network-level security. Once a secure connection is made, a session should be initiated or the secure connection will be closed. Once a session is started, transactions may be processed. Such transactions may include, but are not limited to, card sales and voids. Once a session is closed, no further transactions will be allowed.

A Card/Starts Server is also preferably in charge of maintaining a list of the units that are logged in and at which unit a given game card or pack of game cards is being used. When game card packs are entered into a unit, that unit preferably sends a register message to the Card/Starts Server. The unit must get a response from the Card/Starts Server, or it will not be allowed to participate in the gaming system. If implemented as part of the gaming system, Caller 120 may also request game card validation from the Card/Starts Server, typically on a game-by-game basis.

A preferred Card/Starts Server embodiment holds a database of all game card sales. The Card/Starts Server is preferably configured to hold the username and encrypted password of all users who have authority to sell game cards in the system. When a cashier or manager needs to sell an item of this nature, software in POS 130 creates a secure connection to the Card/Starts Server using the username/password and/or the user's public/private key pair. This user authentication may be performed using a process similar to the dial-in authentication method discussed below. Once a connection is made, a user, depending on his/her access level, may request game cards to sell to a customer. The Card/Starts Server will allocate game cards for the transaction and provide game card information to the user. One advantage of a Card/Starts Server is that all transactions are preferably stored so that no changes can be made without a history of the changes. This prevents someone from changing the information, such as, but not limited to, causing a POS terminal to have more game cards allocated to it than initially requested by an authorized gaming hall employee. Since the Card/Starts Server data is not exposed on the network, it is impossible to bypass the server to allocate game cards. Furthermore, since all winner verification is done by making a request of the Card/Starts Server, any machine that does not contain the game cards allocated thereto by the Card/Starts Server has likely been the subject of tampering, and any attempts to claim a winning prize can be readily invalidated.

In gaming systems containing a Caller 120, POS 130 is preferably notified by Caller 120 when a pre-game sale session ends, such as when a game is about to begin. Such a notification may occur when a Caller 120 operator presses an End of Session button or other user interface element on Caller 120. POS 130 is preferably configured to prohibit card sales for a given session after the session ends. If Caller 120, Master 100, or a Card/Starts Server detects a POS 130 transaction after the session ends, an error report is preferably printed and logged for subsequent analysis.

POS 130 preferably stores sales transactions with sequential transaction numbers. Further, POS 130 may optionally allow the serial number of the game card(s) distributed to a player to be printed on a sales receipt, and optionally permits printing of game indicia on the receipt as well. Transaction data is preferably transmitted to Master 100 and digitally authenticated using a known-secure technique such as, but not limited to, with an HMAC-SHA1 hash encoded with the Hall Private Code, the Secure Group Embedded Secret, and/or the POS 130 operator's user private key.

POS 130 can also generate reports based on sales therefrom. Such reports may include, but are not limited to, transaction reports including a breakdown of sales.

When deployed as part of the gaming system, Caller 120 can perform the functions typically associated with callers in traditional bingo, keno, lottery, or other such games, including game flow, ball calls, game card verifications, and the like. Boot Loader 125 is preferably installed on Caller 120. If a Boot Loader is not installed on Caller 120, the GTI Public Key and GC Public Key are preferably stored on the boot device. Caller 120 also preferably has access to the Secure Group Shared Secrets stored within the software installed thereon.

As described above, Caller 120 performs functions associated with a traditional bingo caller, including winning game card verification. In conjunction with the winning game card verification function, Caller 120 verifies that each winning game card is valid and in play for the current game, and preferably cross references this with the winning player number, or player unit number where the winning game card is an electronic game card, from the game card distribution database and against the sales file. Further, each game card is preferably verified as not having been voided, and where the game card is an electronic game card, that the unit playing the game card is currently logged in. In addition, each winning transaction is preferably checked for valid game card range and card starts values. By way of example, without intending to limit the gaming system, the game cards are checked to determine that the pack does not have more game cards than allowed at the hall, and that the starting game card value is correct based on previous and next sales in the database. Each winning player unit is also preferably challenged with a random value. This challenge must be responded to using the user Group Shared Secret or other private code. If this challenge fails the verification will fail.

Caller 120 also preferably implements an enhanced audit log which tracks record session, game, and ball call information. The enhanced audit log also preferably records game card verification and game card type, and original transaction numbers associated with all electronic sales for any verification. Further, the enhanced audit log preferably tracks the users that log into and out of Caller 120 and the time at which they logged in or out, as well as any keystrokes and/or buttons pressed by the user while logged in.

In addition to selecting balls for an operator to announce to players with paper cards, Caller 120 can also electronically report called balls to portable units 140 and Player Units 150 through network 110 and other wired and/or wireless means. The gaming system supports a variety of portable units 140, including TED$^3$ 145, TED$^2$C 142, and TED 144, as well as the Traveler handheld gaming unit and handheld computers such as the Compaq iPAQ.

TED 144 represents first-generation portable units designed for gaming. TED 144 supports FLASH programming, which will zero out all memory in the unit, except for the block that contains the serial number, unit number, and/or other unique identifiers, thus allowing digital authentication. Further, TED 144 supports random executable subsection checks prior to sale. The TED unit currently does not support MD5 processing, so the random executable subsection checking process used in TED 144 is simply a CRC response.

TED$^2$C 142 represents a second-generation portable gaming unit. TED$^2$C 142 supports RSA key access, including storage of the GTI Public Key locally on a chip in the unit. TED$^2$C 142 also supports on-demand software signature checking and random executable subsection MD5 checks or digital authentication.

Figure 3:
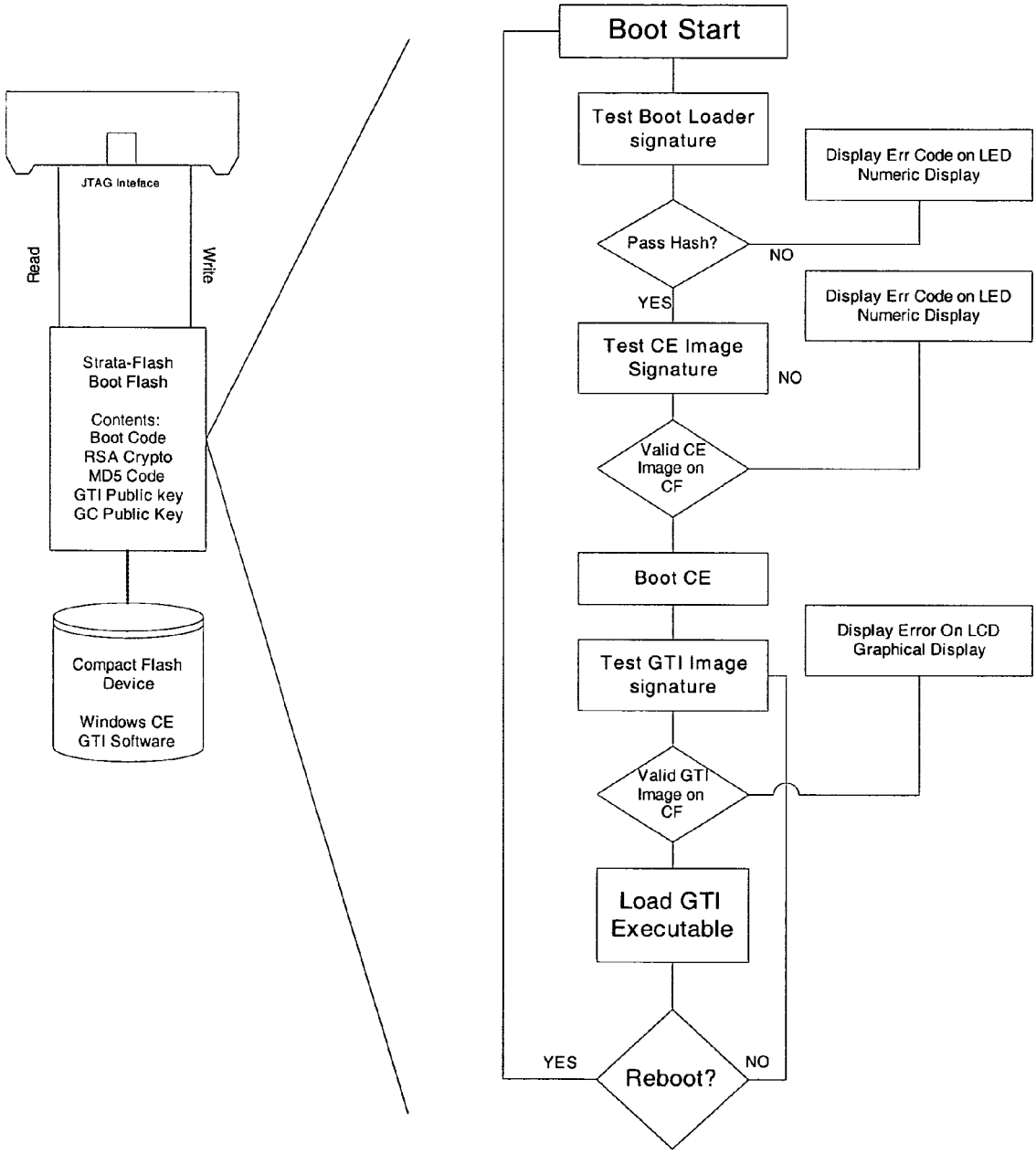
FIG. 3 is a block diagram of a secure boot loader as implemented on non-PC-based game stations.

TED$^3$ 148 represents the latest generation portable gaming unit. TED$^3$ 148 supports a Boot Loader, such as the Boot Loader illustrated in FIG. 3. A Boat Loader for TED$^3$ 148 can be implemented in Strata-FLASH, which is programmable only via a JTAG interface, as a smart card, Read-Only EPROM, or in other forms. A preferred Boot Loader for TED$^3$ 148 is implemented as a read-only EPROM that can be removed from TED$^3$ 148 without opening the entire unit, thereby allowing regulators or employees to easily verify the information stored thereon. When the EPROM is removed from TED$^3$ 148, the unit will no longer function until it is reset with a challenge response value. TED$^3$ 148 also supports the storage of the GTI Public Key on a Compact Flash card or other removable media.

Further, TED$^3$ 148 includes a Tamper Detection switch in the CPU enclosure. Once this switch is triggered, the unit will no longer function until it is reset with a challenge response value. This trigger event is preferably stored in battery backed memory, and the memory can be checksummed. If the checksum fails, the challenge response will again be required.

As with TED$^2$C 142, TED$^3$ 148 also supports on-demand software signature checking and random executable subsection MD5 checks or digital authentication, prior to sale. TED$^3$ 148 preferably has a plurality of player-controlled selection devices through which a player enter information into TED$^3$ 148. Such player-controlled selection devices may take the form of real and/or virtual buttons, such as buttons displayed on a touch-screen, a jog-bar, a thumb wheel, a rocker switch, a touch pad, or the like. TED$^3$ 148 is also preferably equipped with at least one output device, such as, but not limited to, a speaker for playing sounds associated with a given game and a graphical or alphanumeric display for displaying information to a player.

For handheld computers and portable units, the gaming system supports on-demand software digital authentication. To facilitate such digital authentication, a code can be entered or other authentication sequence initiated via a keypad or other user input device, thereby causing the unit to enter digital authentication mode. In one embodiment, initiation of this mode would issue a request for an offset and/or seed value to be used with an MD5 hash, where the seed value is provided by POS 130, Master 100, or a Card/Starts Server. The unit preferably responds with a signature or the like that can be validated at Master 100, POS 130, or the Card/Start server with the same input parameters. The gaming system also supports random executable subsection MD5 checks or digital authentication prior to sale or distribution of portable units 140.

Player Unit 150 is preferably a fixed (i.e., not transportable) interface through which a player can participate in one or more games. Boot Loader 155 is preferably installed in Player Unit 150. If Boot Loader 155 is not installed in Player Unit 150, the GTI Public Key and GC Public Key are preferably stored on the boot device.

From a security perspective, Player Units 150 and portable units 140 are perhaps the most vulnerable part of the gaming system because they connect directly to the network and require at least some physical user interface capabilities. In the embodiment illustrated in FIG. 1, Player Unit 150 and portable unit 140 preferably have read-only access to Drive 106, and a separate registration file is preferably written by Master 100 that is used to prevent the same game card or game card packs from being distributed to multiple units. Player units 150 and portable units 140 can be seen as slave terminals to Master 100.

In the embodiment illustrated in FIG. 1, COM 160 is responsible for reporting transaction and security related information to the manufacturer, such as for billing purposes, and may also be used by the manufacturer for remote administration of the gaming system. As described above, COM 160 is preferably implemented with a Boot Loader. If a Boot Loader is not installed on COM 160, the GTI Public Key and GC Public Key are preferably stored on the boot device.

COM 160 preferably supports a user call-back option, thereby allowing remote administration. In one embodiment, when COM 160 receives an incoming call, COM 160 will ask for a username and password which, once validated, will cause COM 160 to disconnect the call. In this embodiment, it is presently preferred that the password associated with a call-back request be implemented as an S/Key, or shifting key password, such as those supported by the SecurID product line, produced by RSA Security, Inc. of Bedford, Mass. Where a call-back system is used, COM 160 then determines an appropriate call-back number and establishes a dial-out connection to the user. It is presently preferred that at no time during the incoming call will COM 160 accept any commands or keystrokes except those associated with usernames and/or passwords.

In an alternative embodiment, a dial-in public/private key may be used according to process steps similar to the following:

i. The connection is made;

ii. Host (e.g. manufacturer's office) requests a key from Com 160;

iii. COM 160 generates a random public/private key pair. It encodes the public key with a Dial-In Public key that it has stored locally. Since only the manufacturer's office has the private key to decrypt data encrypted with the dial-in public key, it is safe to transmit the random key pair to the Host;

iv. Host receives the key, and decodes it using the Dial-In Private key;

v. COM 160 then requests a login;

vi. Host generates an HMAC-SHA1 hash of the username, or digital authentication thereof, encodes this with the key it received, and sends this to COM 160;

vii. COM 160 verifies the username and then prompts for the password;

viii. Host uses an HMAC-SHA1 hash of the password, encodes the hash with the key it received, and sends this to COM 160.

ix. COM 160 verifies the password and gives the appropriate access.

The above-described process gives the added benefit of a temporary key pair that can be used to transfer additional information in a secure manner, such as username/password maintenance information.

Through the above-described architecture, each technician, accountant, or other manufacturer employee who needs access to Master computers may be issued a digital signature, public/private key pair, or the like. When a manufacturer employee attempts to remotely communicate with Com 160, the gaming system preferably implements a communications security process similar to that illustrated in FIG. 4.

Figure 4:
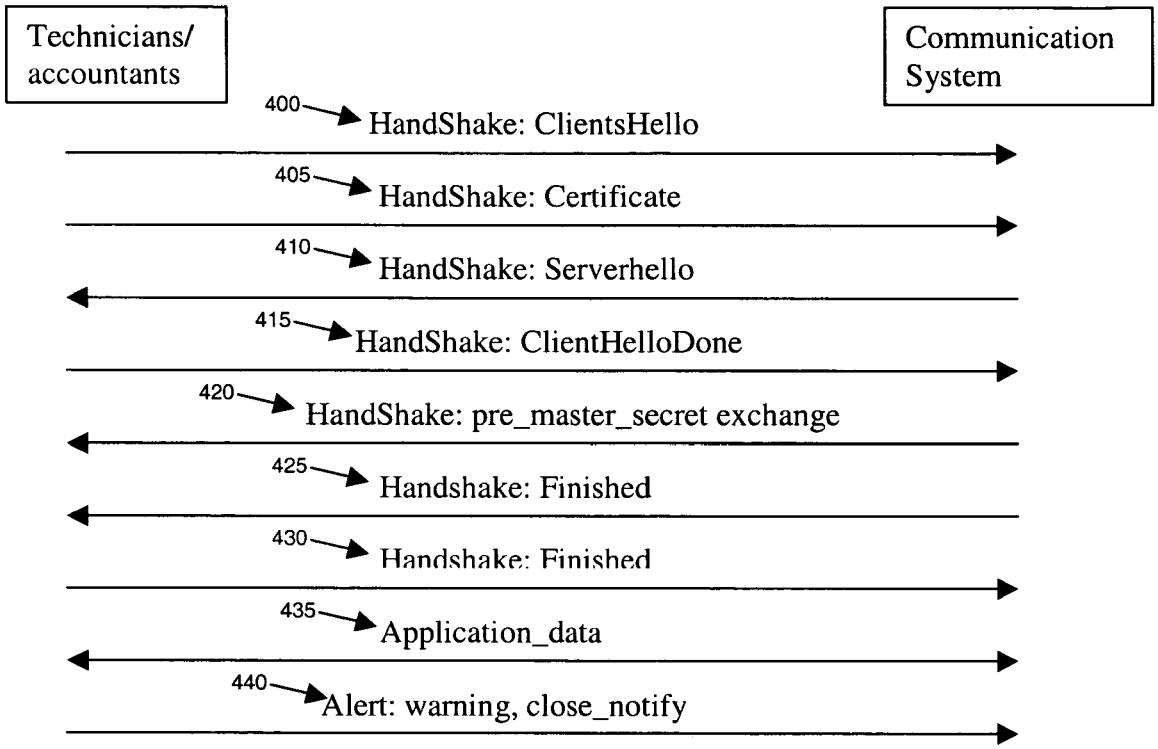
FIG. 4 is a communications flow diagram illustrating a preferred user authentication method.

In FIG. 4, the computer from which the manufacturer employee is attempting to dial into the hall initiates communications with Com 160 by issuing a ClientHello handshake message (400). Pseudocode implementing a preferred ClientHello message is provided below.

```
ClientHello
    struct{
        ProtocolVersion client_version;
        Random random;
        SessionID session_id;
        CipherSuite cipher_suite;
        CompressionMethod compression_methods;
} ClientHello;
```

When the manufacturer employee computer has finished sending the ClientHello handshake message, the manufacturer employee computer can transmit a version of the manufacturer employee's public key which has preferably been encrypted or signed using the GTI Private Key (405). Com 120 then issues a ServerHello handshake message (410), and the manufacturer employee computer can respond by issuing a ClientHelloDone handshake message (415). Pseudocode implementing ServerHello and ClientHelloDone messages is provided below.

```
ServerHello
    struct{
        ProtocolVersion server_version;
        Random random;
        SessionID session_id;
        CipherSuite cipher_suite;
        CompressionMethod compression_method;
    }ServerHello;
ClientHelloDone
    struct { } ClientHelloDone;
```

When Com 160 receives the ClientHelloDone handshake message, Com 160 preferably extracts the manufacturer employee's public key from data transmitted as part of step 405. Because the manufacturer employee's public key was signed using the GTI Private Key, Com 160 can be assured that the manufacturer employee's public key is authentic. Com 160 can extract information about the manufacturer employee from the public key, including, but not limited to, a user name, access rights, and the like.

In the embodiment illustrated by FIG. 1, Com 160 may periodically communicate with one or more manufacturer computers to obtain a list of expired certificates or public keys. Such a list is preferably signed using the GTI Private Key. When a manufacturer employee attempts to dial in, the public key provided as part of step 410 may be cross-referenced against the expired certificate list, thereby providing additional security. Key pairs may also have an associated validity lifetime, thereby further enhancing overall gaming system security.

Corn 160 preferably generates a random transaction public key for the current dial-in session, and this transaction public key is preferably encrypted using the manufacturer employee's public key. The transaction public key is then transmitted to the manufacturer employee's computer as part of a pre_master_secret handshake message (420). Pseudocode implementing a pre_master_secret message is provided below.

```
PremasterKeyExchange
    struct{
        select (KeyExchangeAlgorithm) {
            case rsa: EncryptedPreMasterSecret;
        }
        }ClientKeyExchange;
    struct{
        ProtocolVersion client_version;
        Opaque random[46];
        }PreMasterSecret;
    struct{
        public-key-encrypted PreMasterSecret pre_master_secret;
}EncryptedPreMasterSecret;
```

When the manufacturer employee's computer receives the pre_master_secret exchange handshake message, it decrypts the transaction public key using the manufacturer employee's private key. In a preferred embodiment, the manufacturer employee is required to enter a password to decrypt the private key. The manufacturer employee's computer issues a Finished handshake message (430), indicating that the transaction public key was successfully received.

Once an employee has logged in using a secure login process similar to that of FIG. 4, Corn 160 and the manufacturer employee's computer can pass data in a secure manner using the manufacturer employee's public/private key pair and the transaction public/private key. To verify that everything is working properly, Corn 160 preferably issues a Finished handshake message (425), and the manufacturer employee's computer can issue a Finished handshake message (430) in response. Such a Finished handshake message may include a digest of the transaction public key and other data exchanged during the handshake, which both sides can compare to verify that the handshake has not been tampered with. Psueudocode implementing such a Finished handshake message is provided below.

```
Finished
 struct{
        Opaque verify_data[12];
}Finished;
```

Com 160 and the manufacturer employee's computer can now exchange application data (435). Both Corn 160 and the manufacturer employee's computer preferably locally log any application data transmitted in an encrypted file. When the manufacturer employee is finished communicating with Corn 160, the manufacturer employee's computer can issue a close_notify message indicating that the session is to be terminated (440).

As indicated above, COM 160 should preferably support multiple access level rights based on usernames and passwords. The default rights for any new users should be at most read-only. COM 160 also preferably logs all dial-in calls and transaction information both locally and on Drive 102.

Perhaps the only aspect of the fundamental gaming system architecture which may not be readily apparent from FIG. 1 is the isolation of COM 160, Caller 120, and Master 100 behind a separate network switched hub. This isolates traffic between those devices, and this limits the effectiveness of network packet sniffing and other activities on the publicly accessible portion of the network.

Dial-in and/or call-back techniques are presently preferred because of the enhanced security associated with keeping COM 160 or the equivalent off of an always-on communications means such as the Internet. However, it should be apparent to one skilled in the art that alternative remote administration means may be substituted therefor without departing from the spirit or the scope of the invention. By way of example, without intending to limit the gaming system, COM 160 may be a Virtual Private Network (VPN) server which utilizes the above-described authentication methods or the like to restrict access to the gaming system while at the same time allowing for remote administration via a high speed, ubiquitous, low cost communications means such as the Internet.

FIGS. 1 through 6 illustrate an embodiment through which a secure gaming system can be implemented. Still another embodiment may implement a PKI within the gaming system which utilizes one or more Certificate Authorities (CA) and/or Registration Authorities (RA) to manage digital certificates used within the gaming system.

A digital certificate is an electronic "identification card" that establishes a user or machine's credentials for identifying itself as a legitimate part of the gaming system, and that allows for secure communication among gaming system participants. Digital certificates may be generated by individual units, or digital certificates may be issued by a certification authority (CA). A digital certificate preferably contains the machine name or machine ID, a serial number, expiration dates, a copy of the machine's public key (used for encrypting messages and digital signatures). If issued by a CA, a digital certificate also preferably includes the digital signature of the certificate-issuing authority so that a recipient machine can verify that the certificate is real. A preferred embodiment of the gaming system uses digital certificates that conform to the X.509 standard. Digital certificates can be kept in registries so that authenticating machine can look up other machine's public keys.

Generally, RA's are responsible for verifying the identity of a user requesting certification. In an embodiment of the gaming system, an RA is implemented in the human resources or other similar department of the manufacturer or authorized third party (collectively referred to as manufacturer). To properly verify the identity of the user requesting certification, the RA effectively runs a background check of the user. In the gaming system, such a background check may include, but is not limited to, searching through the human resources department records at the manufacturer to validate information provided by the user as part of the certificate request. Once the user is properly authenticated, the public key is associated with the user and the RA can submit a signed copy of the public key and certificate request to the CA, thereby allowing the CA to issue a certificate. Where a digital certificate is issued to a person, a digital certificate can include:

a. The name of the holder
b. Serial number
c. Expiration date
d. Holder's certificate
   i. Common Name
   ii. E-mail
   iii. Mail
   iv. Phone
   v. Organization
   vi. Org Unit
   vii. Country
   viii. Public key of the Holder
e. The digital signature of the certificate authority The items listed above are intended to be exemplary and should not be construed as limiting digital certificates to only those containing the above listed items. It should be apparent to one skilled in the art that items may be added to, or removed from, the above list without departing from the spirit or the scope of the invention.

Figure 23:
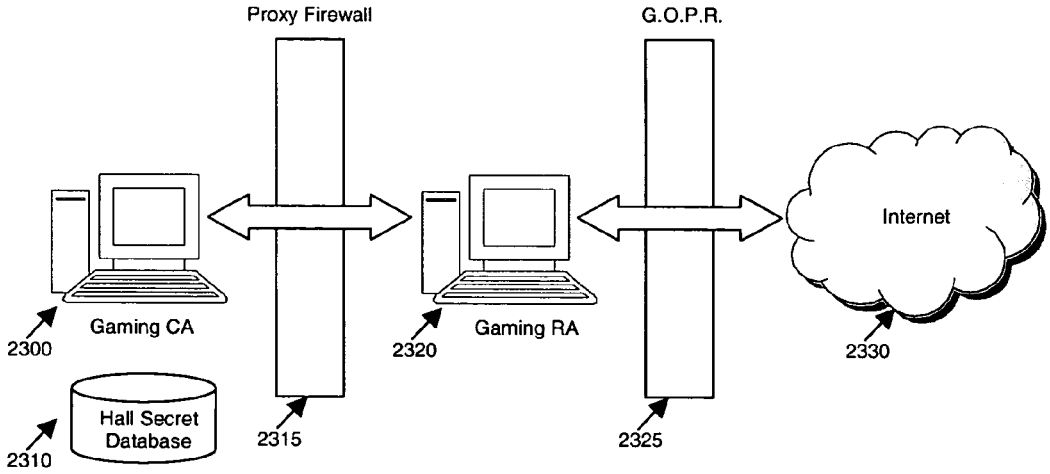
FIG. 23 is a network architecture though which a registration authority can be implemented.

FIG. 23 illustrates an architecture which utilizes one or more RA's 2320. The RA should preferably reside in the office of the gaming system manufacturer or a trusted third party for receiving certificate requests from the field and from internal manufacturing. RA 2320 should process certificate requests for verifying a requestor's digital signature, and should submit such requests to a GTI Gaming CA 2300 (described in more detail below) for issuing certificates if the verification is successful. GTI Gaming CA 2300 is preferably protected from Internet 2330 by a proxy firewall 2315 with strong security policy enforcement, packet filtering, stateful inspection, and application level control as illustrated in FIG. 23. Access to RA 2320 should also be restricted to properly authenticated users or machines via a secure login system 2325. RA 2320 can also be used to request current dialup passwords for specific halls, request current LANtastic or Windows passwords, console access passwords (on DOS systems), or dialup passwords for a specific Hall.

All such request will preferably be logged to provide an audit trail of who had access for which time periods to which gaming hall. Access to specific halls will be controlled and managed by region, authorization, etc. Notices will be proactively sent and logged when technicians request passwords that provide access to critical functions.

Figure 18:
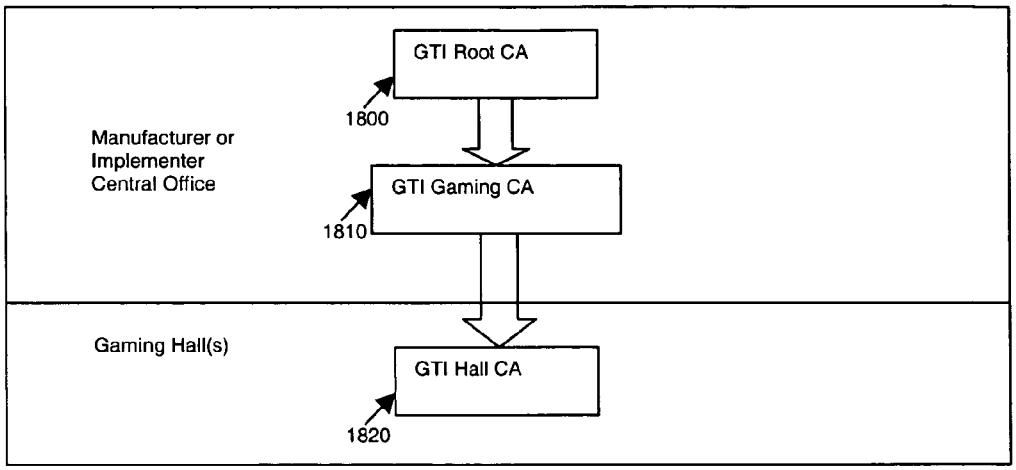
FIG. 18 is a block diagram illustrating an architecture through which PKI can be implemented within a gaming system.

FIG. 18 illustrates a CA architecture implemented in a preferred PKI-based embodiment. As FIG. 18 illustrates, a gaming system manufacturer or underwriter will preferably maintain a GTI Root CA 1800. GTI Root CA 1800 is the most critical entity within the PKI. GTI Root CA 1800's self-signed root certificate is preferably embedded in all GTI software and secure boot loaders. The self-signed root certificate is preferably used to authenticate all software and related files. Using GTI Root CA 1800's root certificate, any unit or software thereon within the gaming system can authenticate communications received from outside the gaming system, such as via Com 160 of FIG. 1, as authentic.

Referring again to FIG. 18, to minimize the risk of security compromise of the root CA, its functionality is preferably limited to issuing, managing, and revoking certificates to Gaming CA 1810. Gaming CA 1810 preferably handles the day to day operation of issuing, managing, and revoking certificates to gaming halls and creates digital authentication for executables and related files.

GTI Root CA 1800 preferably uses a FIPS Level 3 Certified Hardware Security Module (HSM), such as the Luna CA$^3$ manufactured by Rainbow-Chrysalis, Inc. of Ottawa, Ontario, Canada, to generate a private key and public key pair and to store the key pair in tamper proof hardware. The private key and public key are preferably generated using the HSM's random number generator. The private key preferably never leaves the HSM module's tamper proof hardware.

Because of its significance, GTI Root CA 1800 should preferably be kept within a secure area in the manufacturer or underwriter's office. GTI Root CA 1800 is also preferably implemented as a stand alone server, meaning that it is not connected to any network. GTI Root CA 1800 preferably requires at least two authorized GTI employees' hardware tokens to issue and/or revoke a certificate.

GTI Gaming CA 1810 is preferably a subordinate CA from GTI Root CA 1800. GTI Gaming CA preferably generates and issues digital authentications to executables and related files. GTI Gaming CA 1810 should have a valid certificate from GTI Root CA 1800 to function. GTI Gaming CA 1810 preferably generates digital authentication of executables and related files using its own private key. In another embodiment of the invention, GTI Gaming CA 1810 can generate digital signatures of executables and related files using its own private key by generating an MD5 hashed value of the executables or related files and encrypting the hashed value with the private key. GTI Gaming CA 1800's whose corresponding public key is preferably managed by GTI Root CA 1810 via digital certificate.

Digital authentication of executables and related files, or digital signature verification of executables and relates files, is preferably performed by encrypting the executables or related files with a private key associated with GTI Gaming CA 1810. When executables or related files are shipped to a gaming hall, units within that gaming hall's gaming system preferably verify the digital authentication of the executables or related files by decrypting the encrypted executables or related files with the attached GTI Gaming CA 1810's public key and identifying the identification string. The digital signature can also be verified by decrypting the encrypted hashed value with the Gaming CA's public key and comparing the decrypted hashed value with a generated hashed value of the received executables or related files. Before the decryption, a unit may also validate the public key or associated digital certificate associated with GTI Gaming CA 1810 with the embedded root certificate via certificate chaining.

Another important feature of GTI Gaming CA 1810 is that it also issues, manages, and revokes digital certificates to individual GTI Hall CA's 1820. GTI Hall CA's 1820 can issue, manage, and revoke digital certificates within a gaming hall, both during gaming system installation and as games are played.

At least one GTI Hall CA 1820 is preferably implemented in each gaming hall. GTI Hall CA 1820 is preferably implemented as part of a Card/Starts Server, also referred to herein as a BGC server. By issuing a digital certificate to GTI Hall CA 1820, the gaming system can ensure that individual units within the gaming system authenticate the BGC server as an official server of the gaming system. The units preferably authenticate the BGC Server as an official gaming system server by validating the digital certificate of the BGC server from GTI Gaming CA 1810 with its embedded GTI root certificate during SSL/WTLS handshakes.

Handheld and portable units on which wireless communications have been implemented preferably implement Wireless Transport Layer Security (WTLS). WTLS is the security layer for Wireless Application Protocol (WAP) applications. Based on Transport Layer Security (TLS) v1.0 (a security layer used in the Internet, equivalent to SSL 3.1), WTLS was developed to address problems facing mobile network devices, including the limited processing power and memory capacity of typical handheld units, and relatively low bandwidth with which to transmit information to and from the handheld units. WTLS also provides adequate authentication, data integrity, and privacy protection mechanisms. Designed to support datagrams in a high latency, low bandwidth environment, WTLS also provides an optimized handshake for DOS-based BGC servers using LANtastic 8.0. WTLS is advantageous because it uses datagrams through dynamic key refreshing, which allows encryption keys to be regularly updated during a secure session.

During installation of a BGC server within a gaming hall, technicians can request a Hall private and public key pair for GTI Hall CA 1820. The technicians can transmit the certificate request for the newly generated Hall private key and public key pair to a GTI Gaming CA 1810. GTI Gaming CA 1810 preferably verifies the certificate request and issues a certificate for the Hall CA. To authenticate the BGC server, gaming system units can verify the gaming certificate issued by GTI Gaming CA 1810 using their own embedded GTI root certificate. A BGC server can preferably generate and issue Hall certificates to gaming system units as such units are installed in the gaming system using the certified Hall private key.

Figure 19:
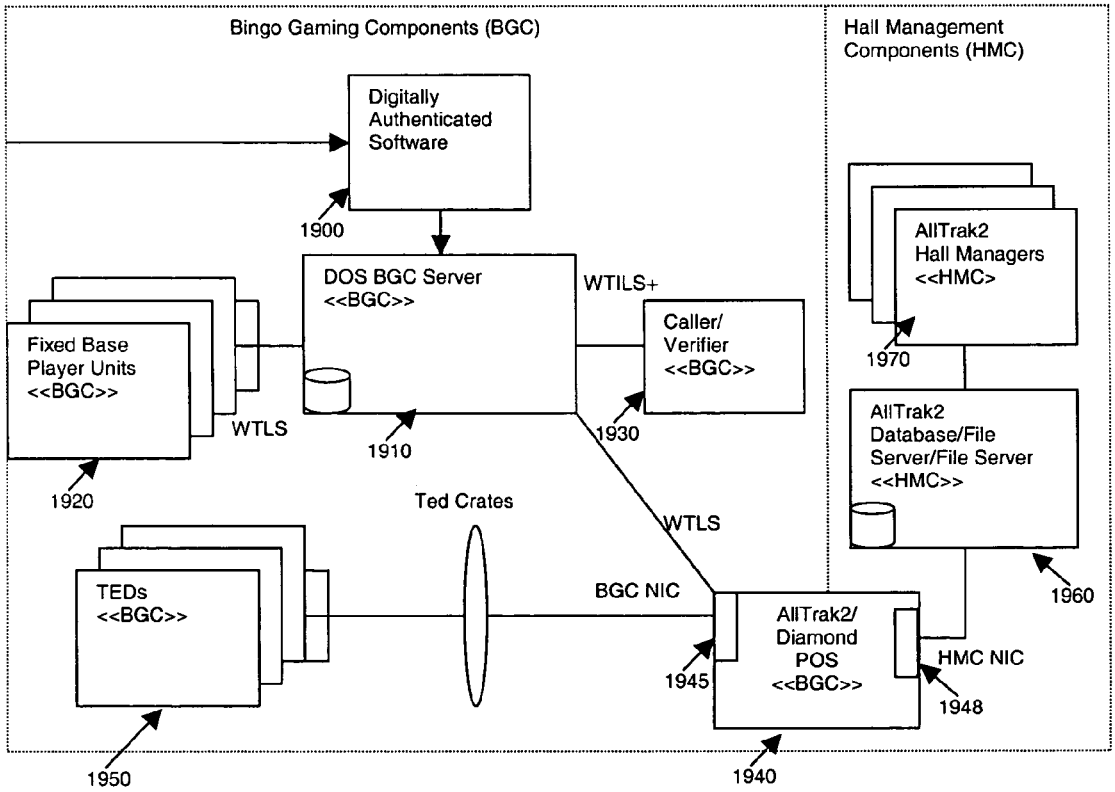
FIG. 19 is a gaming system architecture implemented using a DOS-based BGC server.
Figure 20:
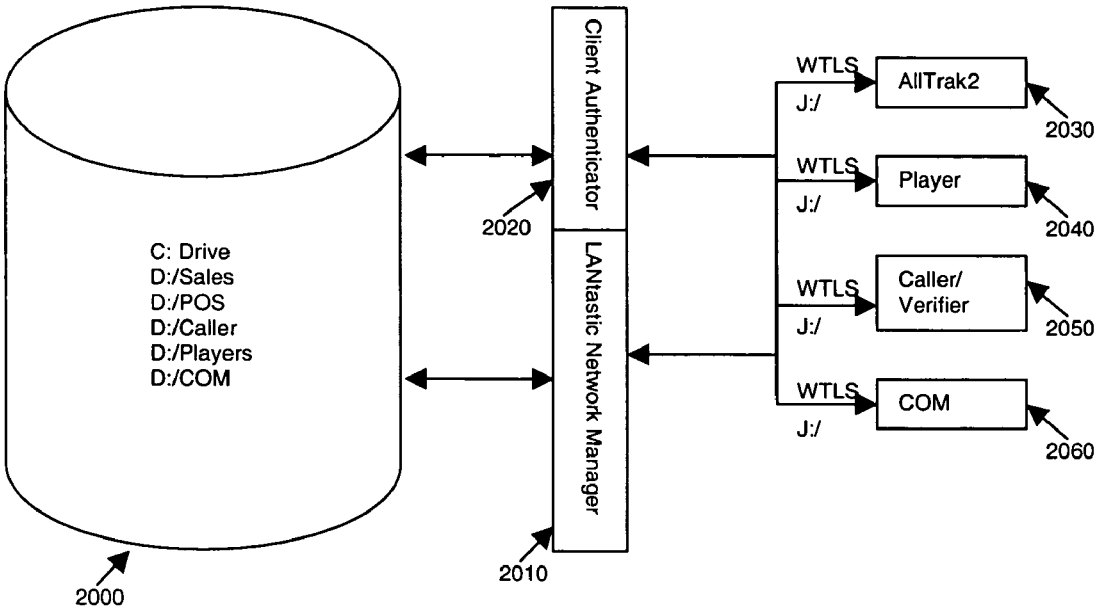
FIG. 20 is block diagram of a preferred DOS-based BGC server.

FIG. 19 is a block diagram of a preferred DOS-based BGC server. As illustrated in FIG. 19, a DOS BGC server is preferably a file server that centrally manages gaming and network data via file sharing. A DOS-based BGC server preferably uses the MSDOS 6.22 operating system, which has been enhanced with LANtastic 8.0 network operating system. A DOS-based BGC server preferably stores executables for caller/verifier, players, POS, and handheld units so that the DOS-based BGC server automatically shadows the latest version of the executables to the units connected thereto during gaming system initiation, or individual unit boot-up. As illustrated in FIG. 20, the C:/ drive of a DOS-based BGC server 2000 can be shared with all of its client units 2030, 2040, 2050, and 2060 as the J:/drive. The DOS-based BGC server can control unit access to its resources via LANtastic Network Manager 2010 or other similar software. LANtastic Network Manager 2010 is a component of the LANtastic Network operating system that manages the access to the server resources by the clients via drive sharing. It creates unique login account with passwords per device type and access controls so that certain clients may have read/write access to certain directory in the J:/drive.

The gaming logics and processing of the data are handled by executables in the clients and all clients write to the J:/drive of DOS-based BGC Server 2000 for sharing and communicating gaming data.

Within a gaming hall, the responsibilities of a DOS-based BGC Server can be divided into two unique sets of components as shown in the table below and illustrated in FIG. 19. These components are generally referred to herein as the Bingo Gaming Components and the Hall Management Components. Bingo Gaming Components manage the actual game play, from sales to cashing out winners. Hall Management Components retrieve and analyze gaming and hall management data. The Hall Management Components also generate reports for the gaming hall managers.

| Bingo Gaming Components | Hall Management Components |
|---|---|
| BGC Server | AllTrak2 Hall Managers |
| Caller/Verifier | AllTrak2 Database/File Server |
| AllTrak2/Diamond POS | AllTrak2 POS |
| Fixed Base Player Units | HMC Network Interface Card (NIC) |
| Portables | |
| Remote Crate Server | |
| BGC Network Interface Card (NIC) | |

As described above, Bingo Gaming Components generally manage actual game play. Game play typically begins with an operator logging into POS 1940. Products sold via POS 1940 may include, but are not limited to, electronic bingo cards, paper bingo cards, pull-tab games, and entertainment services. For actual bingo game play, POS 1940 will preferably record all game-critical sales records such as sold items, sold bingo card numbers, session numbers, starting values, pack numbers, players' names, players' unique IDs, and other game-related rules at DOS-based BGC Server 1910 by talking to BGC Network Interface Card (BGC NIC) 1945. POS 1940 may also issue one or more receipts for players. POS 1945 should record both a copy of the data written to DOS-based BGC Server 1910 and non-game-critical data, such as, but not limited to, unsold paper card information, VIP player information, and gaming hall employee information, at DOS-based BGC Server 1960 by talking to the Hall Management Components Network Interface Card (HMC NIC) 1948.

At the beginning of a game, all players prepare for play, and caller/verifier 1930 announces commencement of a game. Caller/verifier 1930 preferably broadcasts which game is commencing to the Fixed Base Player Units.

The caller/verifier commences the game by drawing balls out of a blower or other similar system. When a player calls "bingo", a runner determines the winning card number and relays it to the caller. The caller verifies the winning card number by verifying corresponding data in DOS-based BGC Server 1910 previously recorded by POS 1940.

The winners of any bingo game are preferably determined based only on records stored within DOS-based BGC Server 1910. When there is a bingo during a particular bingo game play, caller/verifier 1930 checks the BGC Server's record to determine if the winning card was actually sold to the winner. Each card is preferably verified as not voided, and the player unit will be verified as currently logged in. Each winning transaction will be checked for valid card range and card starts values in records stored within DOS-based BGC Server 1910. Every winning transaction is also preferably checked against whether the pack has more cards than allowed at the hall and the starting card value is correct based on previous and next sales in the DOS-based BGC Server's database.

Hall Management Components generally consist of hall management software 1970 and a database server 1960. Hall Management Components allow for sales data analysis, inventory control, player management, and hall employee management. Hall Management Components do not affect the actual bingo gaming integrity. If desired or required by a jurisdiction, Hall Management Components can be made to read and write only to database 1960, thereby preventing Hall Management Components from interfering with or potentially altering game-critical data. By limiting Hall Management Components to database 1960, Hall Management Components is limited to non-game-critical data such as, but not limited to, unsold card information, players information, hall employee information, and the mirror image of the DOS-based BGC Server's records.

Database server 1960 preferably receives data from POS 1950 via a separate network card, illustrated in FIG. 19 as HMC NIC 1948. This is separate from BGC NIC 1945, which is used to facilitate communications between POS 1940 and the remainder of the gaming system, including, but not limited to, player units 1920, portable units 1950, and caller/verifier 1930. The network cards are preferably not bridged within POS 1940, thereby preventing the HMC network from gaining access to the DOS-based BGC Server. Although wired network cards are presently a preferred communications interface, it should be apparent to one skilled in the art that alternative communications interfaces can be substituted therefor without departing from the spirit or the scope of the invention.

Referring again to FIG. 19, all user input devices, such as, but not limited to, keyboards, mice, floppy drives, or CD drives, other than a touch screen, should be removed from all units other than from BGC Server 1910 and POS 1940. BGC Server should include a keyboard, a mouse, a floppy drive, and a CD ROM for secure software update and maintenance. POS 1940 may have a keyboard, a mouse, and a touch screen monitor.

In computers conforming to the well-known PC architecture, when a PC starts, the microprocessor passes control to the Basic Input Output System, or BIOS. A standard BIOS manages data flow between the computer's operating system and attached devices such as the hard disk, video adapter, keyboard, mouse, and printer. The BIOS is also responsible for initializing the hardware during a boot-up process. The BIOS first determines whether all of the peripherals are in place and operational, then loads the operating system (or key parts of it) into the computer's random access memory from the hard disk, diskette drive, CD-ROM, or other memory device coupled thereto.

Figure 24:
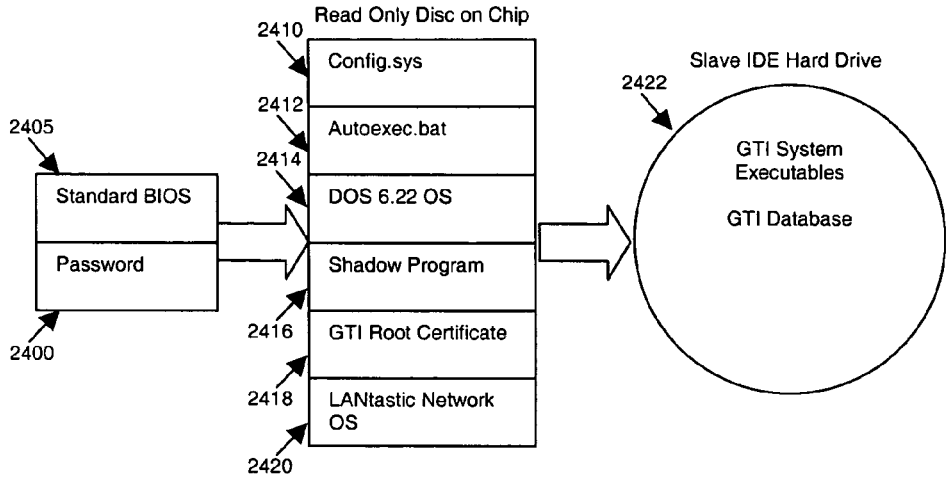
FIG. 24 is a block diagram of a boot loader which can be used in DOS-based units.

A DOS-based secure boot loader, such as that illustrated in FIG. 24, may be used for DOS-based units, including, but not limited to, player units, POS units, and the like. A DOS-based secure boot loader is preferably comprised of a standard BIOS 2405 with a password management/custom read-only segment 2400. Software necessary to permit booting the unit, including a config.sys file 2410, autoexec.bat 2412, DOS operating system files 2414, LANtastic network operating system files 2420, may be stored within read-only segment 2400. When booted from read-only segment 2400, shadow program 2416 can authenticate software and related files stored on hard drive 2422, copy updated software from a known good source to one or more hard drives 2422, and perform other such functions. Read-only segment 2400 also preferably contains a copy of GTI root certificate 2418.

The DOS secure boot loader can utilize standard BIOS management functions for password protection and management. The standard BIOS should be configured to boot only from the DOS secure boot loader. The BIOS password can be managed by regional managers in the field, and the password may be updated every 90 days. A machine with a standard BIOS and a read-only disk-on-chip DOS secure boot loader should be physically secured with the security tape so that only authorized GTI technicians may have access to the internal of the machine.

The GTI root certificate stored in read-only segment 2400 may be used to digitally authenticate new software updates and certificates issued by a Gaming CA and/or a Hall CA. When executed, a secure boot loader should also verify the digital authentication of all executables in hard drive 2422 using the GTI public key within the GTI root certificate.

Shadow program 2416 is software within a DOS-based secure boot loader that manages new software updates. Shadow program 2416 preferably contains digital authentication verification and version control capabilities, thereby allowing it to verify that software is up to date and can be digitally authenticated. By way of example, without intending to limit the gaming system, a DOS-based secure boot loader may control the version number by ensuring that the version number installed on the unit with which the DOS-based secure boot loader is associated is equal to that on the known good source, and that any new software or related files to be installed has a higher version number than the previously installed software.

New software may be downloaded from the J:\ drive of the BGC server. When a new version of the software is available, a shadow program 2416 may copy the new version of the software to a temporary directory on drive 2422 and verify the Gaming CA certificate in drive 2422 with the GTI root certificate. Shadow program 2416 can then use the public key from the Gaming CA certificate to validate the authenticity of all executables or related files within drive 2422.

If the digital authentication is determined to be valid, shadow program 2416 can compare the version number of any previously installed software or related files with the authentic version number of the update. If the version number of the new software update is higher then the version number of the previously installed software, shadow program 2416 will preferably copy the previously installed software into a backup directory and install the new version of the software. After the new version software update, for maintenance purposes, shadow program 2416 may allow the previously installed software in the backup directory to be restored while removing the newly installed software if a proper password is entered.

Figure 22:
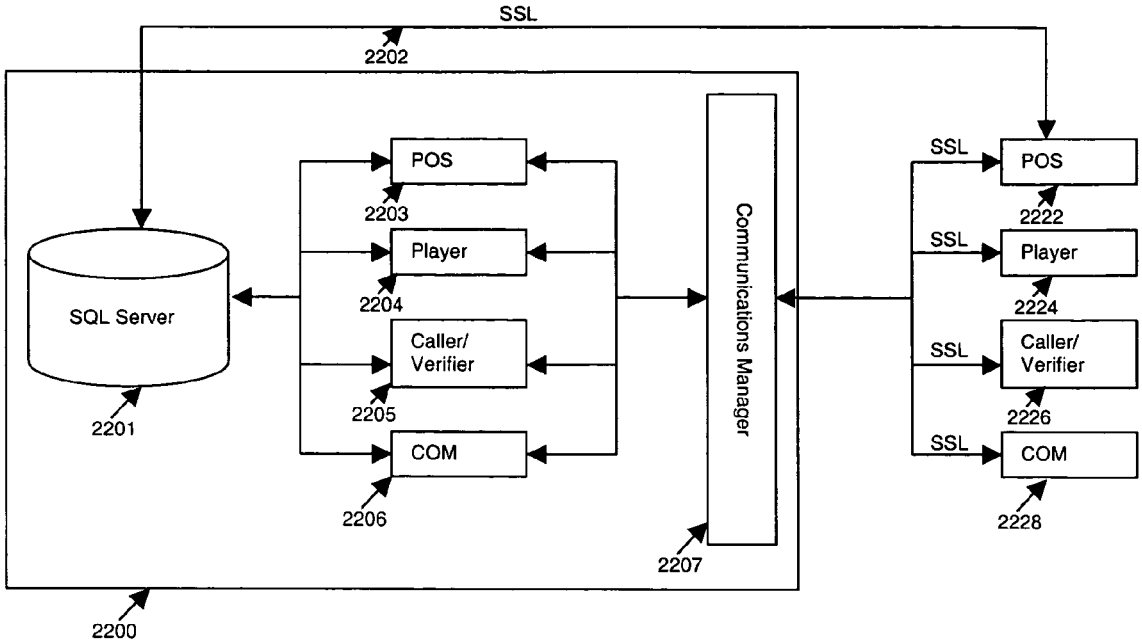
FIG. 22 is a block diagram of a preferred Windows-based BGC server.

An alternative, Windows-based BGC server embodiment is illustrated in FIG. 22. In this embodiment, all core gaming logic, services, and data storage will preferably be centrally processed and executed from Windows-based BGC Server 2200. By placing common functionality into the server component, the various gaming system units can make use of tried and tested functionality regardless of the operating system, platform, or language used in the unit.

This extra layer of abstraction can be accomplished through the use of dynamically linking libraries ("DLL") modules, illustrated as modules 2203 through 2206, written around a common basic architecture. Different module DLL's can be created and loaded to facilitate communications between Windows-based BGC Server 2200 and various units 2222 through 2228, and to provide the functionality associated with the units. The actual server executable is preferably implemented as a Windows NT service, such that it is always loaded as Windows-based BGC Server 2200 is booted. When started, the server executable preferably searches through its current directory and loads all DLL's found to match the specification of a module DLL.

Figure 25:
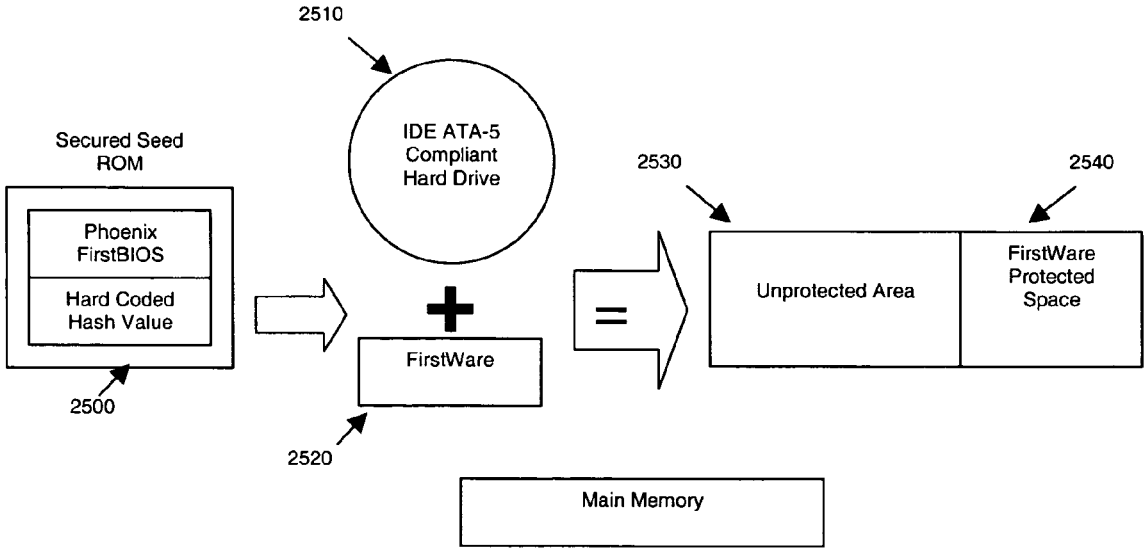
FIG. 25 is a block diagram of a boot loader which can be used in Windows-based units.

Modules may communicate through a common communication manager 2207, which preferably supports WinSock, TCP/IP, and SSL. When a message is received by communication manager 2207 from a client, that message is copied into a message object which is then placed into the incoming message queue. The queue is a thread safe array of messages that are constantly being drawn from by a message distribution thread.

Where a unit utilizes a more advanced operating system, such as, but not limited to, Windows NT, Windows 2000, Windows XP, Windows CE, or Linux, a more advanced boot loader, such as that illustrated in FIG. 25, may be used. Such a boot loader is preferably comprised of a secured FirstBIOS ROM 2500, manufactured by Phoenix Technologies Ltd., of Milpitas, Calif., and an IDE ATA-5 compliant hard drive 2510. FirstBIOS ROM 2500 allows a portion of hard drive 2510 to be partitioned off as a protected, FirstWare space. FirstWare Space is Phoenix's implementation of a host protected area (HPA), as first defined in the ATA-5 specification. Basically, it is a protected area of the hard drive reserved for storage of critical data and applications in a container segregated from the rest of the hardware by an internal "firewall" of sorts. This area can be accessed even when the primary OS is not functional. This protected storage area is accomplished through the use of an ATA command called SETMAX. Issuing a SETMAX command to the hard drive allows the drive to report to the rest of the system that its maximum storage address (reported max) is lower than its actual physical storage limit (native max).

FirstBIOS ROM 2500 is a tamper-proof ROM that stores the cold-boot code, a "seed" of trust, and a hard-coded hash value. FirstBIOS ROM 2500 is a removable chip with security tape on it so that local jurisdictions may remove the chip and verify its contents for security audit at any time. FirstBIOS ROM 2500 can hash-check the intermediate bootable service areas and GTI root certificate against a hard coded hash value stored in the FirstBIOS ROM 2500 to verify its authenticity. Hash functions utilized by FirstBIOS ROM 2500 include, but are not limited to, the algorithms commonly known as the SHA-1/MD5 algorithms.

When the FirstWare space is locked down, an internal access password is used, and that same password is needed to open the FirstWare space. When a computer is equipped with FirstBIOS, the BIOS holds the key to opening the FirstWare Space. Once the machine is committed and the FirstWare space locked, only the FirstBIOS can expose the FirstWare space, and the access password is changed with every opening and closing of the FirstWare space.

Figure 26:
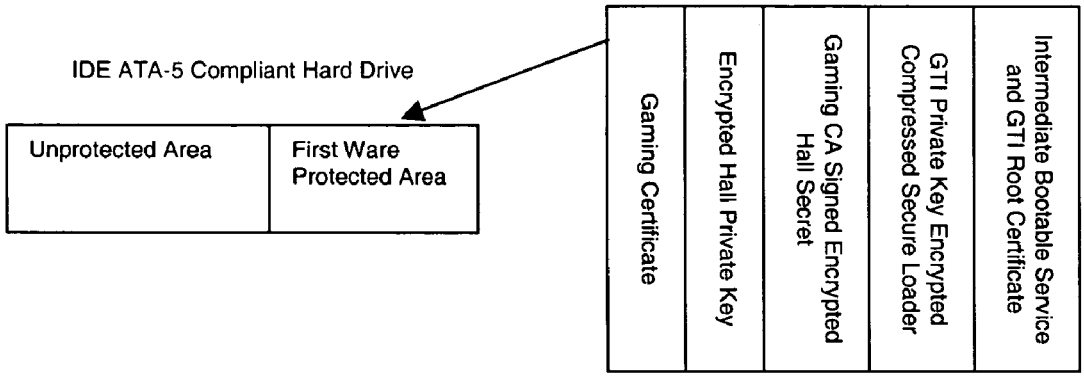
FIG. 26 is a block diagram illustrating information that can be stored in hard disk protected space.

As illustrated in FIG. 26, the following information is preferably stored in the FirstWare space:

Intermediate Bootable Service

GTI Root Certificate

GTI Private Key Encrypted compressed Secure Boot Loader

Gaming CA signed Encrypted Hall Secret

Encrypted Hall Private Key

Gaming Certificate

The intermediate bootable service can insure that the unprotected area within the hard drive contains the following components:

GTI Private Key Encrypted Installation.exe

3DES Encrypted Embedded XP/DOS

3DES Encrypted SQL Server

3DES Encrypted BGC WIN Server

3DES Encrypted Alltrak2POS

Partitioned Gaming Data Drive

The Intermediate Bootable Service is responsible for validating the GTI Root Certificate by verifying its expiration date, extracting the GTI public key from the GTI Root Certificate, and decrypting the GTI Private Key Encrypted Compressed Secure Loader using GTI public key. Once the Encrypted Compressed Secure Loader is decrypted via RSA CBC mode using the GTI public key, the Intermediate Bootable Service can verify GTI identification data, such as "GTI Authentic V.xx" embedded within the decrypted compressed Secure Loader. After the GTI identification data has been successfully identified, the decrypted compressed Secure Loader will be decompressed and loaded into RAM memory for execution.

The GTI Secure Loader is a program that loads the Windows XP Embedded operating system (referred to herein as Embedded XP), distributed by the Microsoft Corporation of Redmond, Wash. Embedded XP operating system is a tailored operating system designed to execute the GTI Gaming System only.

The GTI Secure Loader also preferably loads a database server, such as, but not limited to, SQL Server, distributed by Microsoft Corporation, or MySQL, distributed by MySQL AB of Uppsala, Sweden. The GTI Secure Loader can also load software for implementing a BGC server into RAM from the unprotected hard drive space, if appropriate for the unit.

Figure 21:
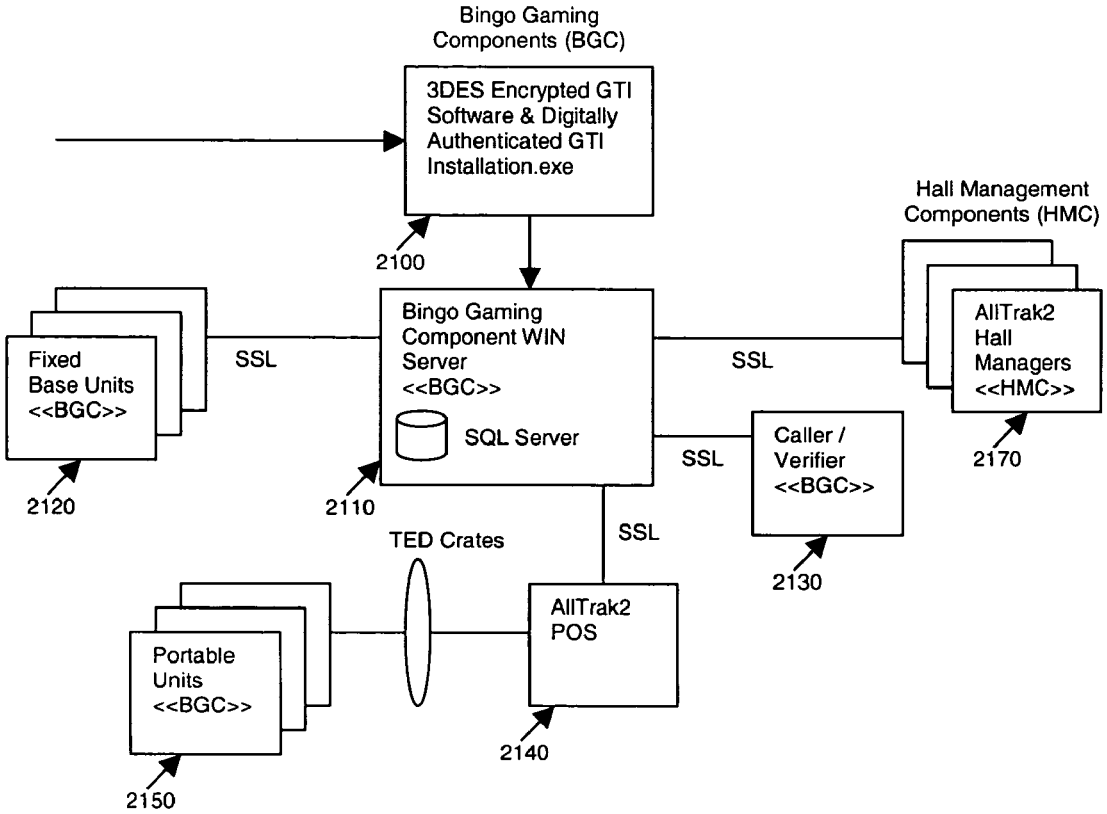
FIG. 21 is a block diagram of a gaming system architecture implemented using a Windows 2000-based BGC server.

When employed in a BGC server according to the embodiments of FIGS. 19 and 21, GTI Secure loader first searches for a GTI Gaming CA Signed Encrypted Hall Secret, verifies the Gaming CA's digital signature of the Encrypted Hall Secret, and prompts a hall manager to type in the password to decrypt the hall secret. If the hall manager types in the correct password for the Encrypted Hall Secret, the Secure Loader will use the hall secret to decrypt the 3DES encrypted Embedded XP operating system, SQL Server, and GTI Server from the unprotected hard drive space. These can then be loaded into system RAM for execution and game play. The Secure Loader preferably verifies the authenticity of the content in the unprotected hard drive space by searching for an embedded GTI authentication ID within the 3DES encrypted executable such as "GTI Authentic V.x.x.". The Secure Loader also preferably has an embedded list of GTI authentic executables and can delete any executables that are not part of the list of GTI authentic executables from the unprotected hard drive space.

If the Secure Loader fails to find the GTI Gaming CA Signed Encrypted Hall Secret or if the user fails to submit the correct password after certain number of trials, the Secure Loader will then look for a GTI Private Key Encrypted Installation.exe within the unprotected hard drive space. The Secure Loader will decrypt the GTI Private Key Encrypted Installation executable using the GTI public Key and verify the authenticity of the GTI Private Key Encrypted Installation.exe by identifying GTI identification data such as "GTI Authentic V.xx" embedded within the decrypted compressed Secure Loader.

If the GTI Private Key Encrypted Installation executable is successfully authenticated, the Secure Loader can execute the GTI Private Key Encrypted Installation.exe, which results in generation of a new hall private/public key pair and transmission of a certificate request for the newly generated hall public key to an appropriate manufacturer CA.

The hall secret is preferably a unique 3DES key generated by a Gaming CA. It is used to authenticate the contents of unprotected hard disk space during boot by decrypting the 3DES key encrypted contents and generating one-time passwords to allow technicians, accountants, and customer support to access the system. The hall secret should be stored 3DES encrypted using the hall manager's password. When the gaming system receives a new hall secret from a Gaming CA, the hall secret will be encrypted using the Hall Public Key so that only the hall that has the corresponding private key may decrypt the hall secret.

Once a new private key and public key pair is generated, GTI Private Key Encrypted Installation executable preferably asks the hall manager to type in a password that can be used to encrypt the private key in PKCS #5 format. The encrypted private key is then preferably stored in the FirstWare protected space.

A technician responsible for installing the gaming system or components thereof can sign the certificate request using his own private key and forward the certificate request to an appropriate Gaming RA. The Gaming RA can then validate the new certificate request by verifying the technician's digital signature, and can forward the certificate request to a Gaming CA by signing it using the Gaming RA's private key. The Gaming CA can validate the certificate request by verifying the Gaming RA's digital signature. If the validation is successful, the Gaming CA can issue a certificate for the hall public key and forward the certificate to the technician. The Gaming CA can also search for the 3DES key used to encrypt the Embedded XP, SQL Server and GTI server installed at the hall and encrypt the 3DES key using the public key submitted for GTI Gaming Certificate. The encrypted 3DES key can then be signed by the Gaming CA's private key.

The technician can receive the Gaming Certificate and the encrypted 3DES key on a laptop or other Internet accessible, portable computing device. The gaming certificate and 3DES key can be transferred to a BGC server using a floppy disk, removable media card, or the like. The GTI Public Key Encrypted Installation executable can then copy the encrypted 3DES key, verify the Gaming CA's digital signature for the 3DES key for authentication, decrypt the encrypted 3DES key using its private key, and store the 3DES key in the FirstWare Protected Space as the hall secret by 3DES encrypting it using the same password used by the hall manager for encrypting the hall private key. The GTI Public Key Encrypted Installation executable can also copy the Gaming Certificate for the hall public key to the FirstWare protected space.

The unprotected hard drive space will be partitioned to store only gaming data and security log to ensure continuous gaming even after accidental rebooting of the GTI Gaming System. The embedded XP operating system and BGC server software will ensure that no executables will be stored in the Partitioned Gaming Data Drive and that no executables will be executed from the Partitioned Gaming Data Drive. The authenticity of Partitioned Gaming Data Drive content is preferably verified by the Security Loader during the boot up process by verifying that only certain files with names matching a pre-defined naming convention exist.

Within a Windows-based boot loader, the BIOS is preferably configured such that a technician may cause a graphical user interface (GUI) to be loaded from the FirstWare protected space. The GUI preferably requests a password and, if an appropriate password is entered, the GUI will permit the technician to choose between updating software and installing software. Software and related files may be installed by a technician from a CD-ROM or other portable media. A technician may copy a new GTI public key encrypted Secure Loader, such as one containing an updated list of authentic executables, and copy the new or updated 3DES encrypted executables into the unprotected hard drive space.

The Password Manager is an application on the BGC server that will execute itself per every system boot-up. It validates the hall certificate on the device using the GTI root certificate. If the hall certificate is invalid or does not exist, it will execute the Master Initializer.

The Master Initializer is an application that generates a new hall secret for DOS-based BGC Servers, along with a new and unique hall private/public key pair at the hall for both DOS-based and Windows-based BGC Servers. For Windows-based BGC servers, a hall secret may not be generated and instead the hall secret can be transmitted from the Gaming CA, preferably encrypted by the newly generated public key. The hall private key and the hall secret will preferably be encrypted either by an embedded password within the Password Manager or by the hall manager's password using PKCS#5 and PKCS#8. When the hall manager enters an appropriate password to start the gaming system or when the system reboots with Password Manager, the hall secret and hall private key will be unencrypted and stored in Random Access Memory in the BGC server.

The Master Initialization Process is the procedure that identifies that the BGC Server installed at the hall is authentic. The Master Initialization Process requires that a new and unique hall secret and hall private/public key pair are generated, a certificate request is generated for the new hall private and public key pair, and the newly generated hall secret is also securely exchanged with a manufacturer corporate office for password generation and synchronization.

During Master Initialization Process in the BGC server, if a hall secret is generated by the BGC server, the hall secret will be encrypted using the public key of the GTI Gaming CA's certificate. Before encryption, the Master Initialization Process will also verify the Gaming CA's certificate using the GTI Root Certificate embedded within the read-only boot loader. The Master Initialization Process then generates a certificate request and the encrypted Hall Secret that is also signed by the Hall private key for the BGC server. The certificate request and the encrypted hall secret will then be given to the technician for uploading to the manufacturer's corporate office.

The technician may copy the certificate request and the encrypted Hall secret by copying the file from the BGC server's slave drive to his laptop via a network connection. The technician then disconnects from the BGC network, connects to the Internet via phone, and submits the certificate request to the Gaming CA.

The Gaming CA will verify the authenticity of the certificate request and the digital signature used to sign the encrypted Hall secret, and then issues the certificate to the technician. For Windows-based BGC Servers, the Gaming CA will preferably search for the Hall Secret, the 3DES key, used to encrypt the content of the executables within the unprotected space in the Windows-based BGC Server, encrypt the Hall Secret using the public key extracted from the valid certificate request from the Windows-based BGC Server, and sign the encrypted Hall Secret using its private key. The technician will then provide the Hall certificate issued by the Gaming CA to the BGC Server by a floppy disk. Any old hall secrets, old hall public/private key pairs, and previously generated database records signed by the old private key are stored and maintained for auditing until the process is successful so that the system can recover from accidental reboot or power loss.

The Database Validator is an application that will read through each secured database file and verify the records using the Hall public key. If any digital signature of the record does not validate, it will flag an error.

The Hall Certificate Authority is an application for DOS-based BGC servers and a component for Windows-based BGC servers that services client certificate requests at the Hall. The Hall Certificate Authority will issue, manage, and revoke the client certificates to the clients. The certificates issued to the clients will be used to authenticate the clients by the BGC Server during the WTLS/SSL handshake. The Gaming CA's certificate that includes the Hall Public key will be used to authenticate the BGC Server by the clients during the WTLS/SSL handshake. This will authenticate both the BGC Server and its clients on the network.

If a new unit is installed and requires the certificates from the BGC Server, the BGC server will broadcast a message to all of its clients requesting a certificate request from any client device that requires a certificate. The BGC server will accept certificate requests from the requesting units and process the information for the technician. The BGC server will distinguish the devices by device type and name. The technician will accept or reject the devices. For secured gaming, the technician alone should not be able to issue a certificate. Issuing the certificate will preferably require both the Hall Manager and the GTI technician to issue a new certificate for a new device. Once the technician makes sure that the new unit is a valid and authentic unit, the Hall Certificate Authority will issue a certificate for the accepted device.

The Client Authenticator on DOS-based BGC Servers is an application that services client authentication requests. The Client Authenticator will preferably accept WTLS handshakes from clients by verifying the client certificates issued by the hall CA, and can send the current LANtastic password for the device type. This functionality could be compiled into the POS or Caller application if needed so that these applications can run on the BGC Server.

In a DOS-based BGC server embodiment, the Client Authenticator will look up the certificate for the unit during the boot phase. Using the certificate, the Client Authenticator will attempt to establish a WTLS connection with the DOS-Based BGC Server. Upon successful connection, the Client Authenticator will request the current LANtastic password and hall private key. The application will then mount the BGC Server's drive shares using the provided password. The LANtastic password preferably should not be stored on the unit. Upon a rejected connection, the Client Authenticator should display a screen that informs the technician that the device needs to be authenticated on the network. The Client Authenticator should wait for a broadcast message from the Hall Certificate Authority. When the message is received, it will generate a public/private key pair and send a certificate request to the Hall CA in the BGC Server. Such certificate requests preferably include the device name and device type (POS, player, caller, etc.). When the certificate is from the BGC Server, the Client Authenticator will store the certificate in its own rewriteable media.

The Client Authenticator for Windows-based BGC Servers is an application that accepts SSL handshakes from clients by verifying the client certificates issued by the Hall CA and exchanging the session key for all subsequent messaging with the server. For Windows-based BGC servers, all communication between the server and its client units will be handled by messaging over TCP/IP. The Client Authenticator for Windows will not exchange LANtastic passwords.

In a Windows-based BGC server environment, the Client Authentictor for Windows is preferably responsible for establishing an SSL connection with the BGC Server to receive the current session key and/or the LANtastic login/password. Both the LANtastic login/password and the session key are generated by the BGC Server and have a lifetime for the Bingo Session. Both are used to secure all broadcast messages for the bingo session. All broadcast messages are preferably 3DES encrypted with the session key.

POS units should preferably include a Certificate Request forwarder. The Certificate Request forwarder will preferably broadcast to portable devices in a crate to send certificate requests. It will accumulate the requests and display them to a technician for review. The application will then forward the request (via SSL) to the Hall Certificate Authority application on the BGC Server, which will issue certificates to the portable devices' public key. The POS unit will send the certificates to the appropriate devices.

When the POS unit starts, it preferably looks up its certificate and performs the Client Authenticator application on all wired, DOS-based gaming units, such as, but not limited to, fixed player units. The POS unit will establish an SSL connection with the BGC server over TCP/IP and retrieve the LANtastic login/password, if one is used. The POS unit will establish an SSL connection with the BGC server to retrieve the current Session key.

To create a secure gaming system, all portable units attached to or participating in the gaming system should be authenticated. At catalog or program download and at the time of sale, portable units should provide appropriate certificates to a POS unit. The POS unit will validate unit certificates and inform individual units of their status. If the certificate is rejected or the unit does not have a certificate, then it will communicate to the POS that it requires a certificate and provide some visible indicator that it needs to be authenticated before it can be used. The unit will then wait for a message from the POS. The POS will acknowledge when it is ready to validate the unit, and the unit will generate a public/private key pair and send the POS a certificate request. The POS will accumulate the various machine names and types and display them for the technician to confirm. Once confirmed, the POS will request certificates from the BGC Server for each device and send the certificate to the unit via a docking crate or other communications means. The unit will then store the certificate.

At time of sale, the POS will wrap the Session Secret in the public key for the device. This will prevent unauthorized devices on the network. The device can then use the Session Secret for receiving and sending broadcast messages.

The Server Authenticator for gaming systems in which a DOS-based BGC server is used is an application running on the units that initiates WTLS connections to the server and also verifies GTI Gaming CA's certificate of the server. The Server Authenticator initiates WTLS connection to the server to obtain the acceptable LANtastic password for its device type at that time.

The Server Authenticator for gaming systems in which a Windows-based BGC server is deployed is an application running on the client units that initiates SSL connections to the Windows-based BGC server and also verifies GTI Gaming CA's certificate of the server. This application authenticates the Server, exchanges a session key with the server, and uses the session key for all subsequent messaging.

Each gaming system unit or component that writes critical records in a BGC-stored table must sign each such record using the unit's own private key. For DOS-based BGC server environments, only POS and player units may write sales records. All POS and player units are required to generate their own private and public key pairs and receive certificates from the hall CA for network security. The POS and player units will use the private keys for signing critical records.

Through the architecture described above, the gaming system provides a distributed, secure, cash and cashless modular platform through which local and distributed gaming subsystems can operate seamlessly over a wide area network. The gaming system is readily adaptable to shifting regulatory requirements and the differing regulatory requirements for the different game types. By way of example, without intending to limit the present invention, games such as, Nevada Bingo, Rainbow Bingo, EDGE, Electronic Pull-tabs, Slot Machines, Lotto, and Video Poker can be easily and simultaneously made available to players using the secure, distributed system architecture and resources of the gaming system. The gaming system can also easily accommodate variations in size of a deal, the payout percentage, and other such parameters.

The following embodiment illustrates the use of the gaming system to deploy an enhanced electronic pull-tab, or eTab, game. eTabs is an advanced implementation of a traditional electronic pull-tab game that preferably provides excitement and visual stimulation to the player, facilitates and broadens game play participation within and/or across multiple sites, provides players simultaneous pull-tab gaming opportunities while playing traditional bingo or other games at the same time and/or terminal, minimizes labor and transaction costs for the gaming operator; and minimizes distribution costs.

Figure 5:
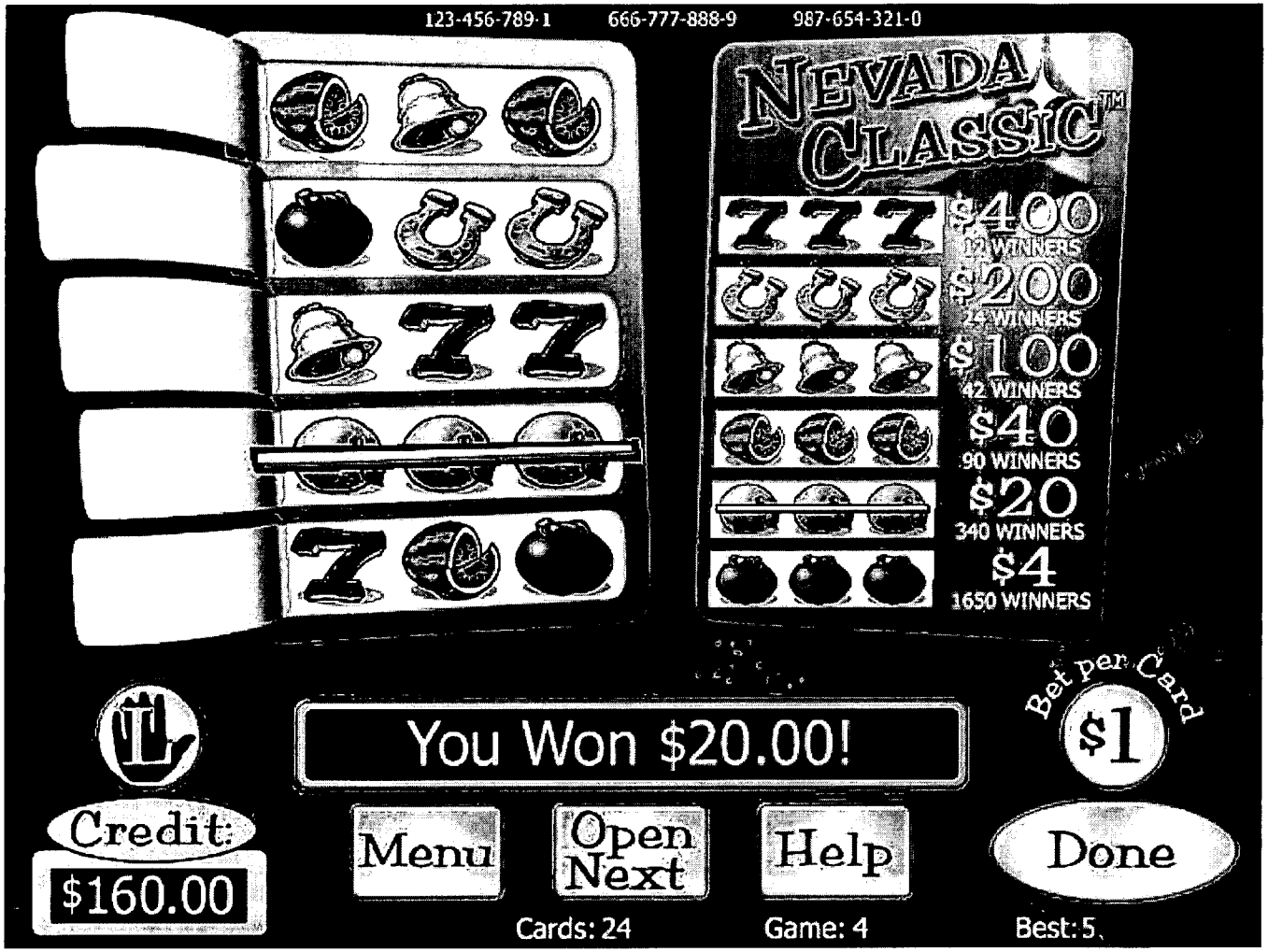
FIG. 5 is a screen capture of an exemplary embodiment of an electronic pull-tab game.

As seen in FIG. 5, which provides a screen capture of an eTab game, the theme, style, and payout of the games can be easily varied using the gaming system. eTabs can provide electronic pull-tab style games, as well as scratch off games, slot style games, and other visually stimulating game presentations, based on predetermined game play outcomes.

Figure 6:
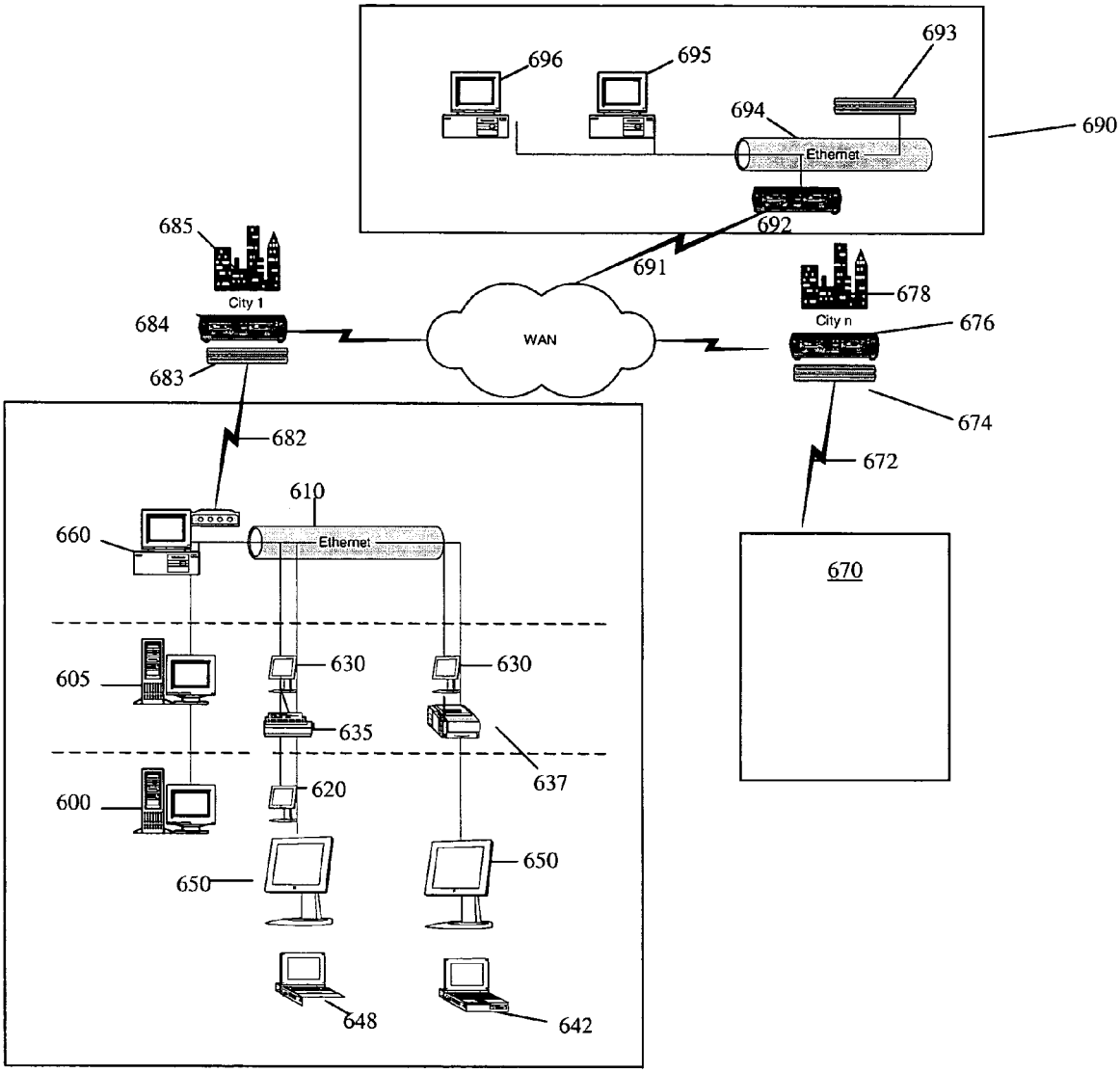
FIG. 6 is a schematic diagram of a preferred gaming system.

The architecture of the gaming system embodiment illustrated in FIG. 6 comprises central gaming server 696 and central pull-tab server 695, which may be linked together via an Ethernet connection 694 and to WAN 686 via router 692. Local modem bank 693 is also preferably attached to Ethernet connection 694. Router 692 preferably provides various localities or operators 685, 678 access to games. Having multiple operators linked to the system also allows for mega-games or jackpots with mega deals and cases between multiple operators. Game card distribution could also be limited to a customer's central or local location(s) on an as needed basis, thereby allowing several casinos on the same link to play from a large deal which has been split into parts for distribution. Game themes can be created wherein a special logo, large prize, or other characteristic is used to makes a game unique for a group of casinos or halls. A large deal with larger prizes among a number of unassociated casinos or halls may allow customers to partake in a Super Tab game.

The eTab games are preferably distributed by servers 696, 695 through wide area network 686. Locality or operator 685, 678 also preferably has a corresponding router 684, 676 and modem bank 683, 674. Each locality or operator 685, 678 is preferably in communication with a corresponding local network 680, 670, through electronic communication link 682, 672.

Local networks 680, 670 preferably include a modem, router, or COM Unit 660. Local networks 680, 670, also preferably include an Ethernet or other network connection 610 which connects Master servers 600, 605; COM Unit 660; Caller 620; POS units 630; player units 650; and portable units 640. COM Unit 660 preferably acts as a primary security gate and router. Master servers 600, 605 preferably store games and related account information. Master servers 600, 605 also preferably houses software used to operate the gaming system at the gaming hall level. A pull-tab operator may have his own caller station 620, or it may be the same caller station used by a bingo caller in an embodiment in which bingo and pull-tab games are routinely played together. In addition, POS Units 630 may have attached printers 635, 637 such as laser or thermal printers. Printers 635, 637 may be used to print paper pull-tab games, tickets, receipts and the like for use with the gaming system.

As an illustration of the interaction of the various components and operation of the system, a tribal casino 685 might already be conducting a bingo night using an electronic bingo system. In such an example, tribal casino 685 may employ local network 680 to play a distributed electronic bingo game. The hall operator can request and specify the type and structure for a new case or deal of eTab game cards though an attached, and preferably secure, Master 600. The request is preferably sent through COM 660 and WAN 686 to central gaming servers 695, 696. Central gaming servers 695, 696 formulate the correct number of winning game cards, payouts, serial numbers, and the like, and randomly assign winning game cards to specified serial numbers.

The eTab deal data is then preferably transmitted to local servers 600, 605. The hall operator opens the transmitted eTab deal, at which time software resident on servers 600, 605 randomly transmits the serial numbers to players purchasing eTab games from the various POS Units 630, player units 650 or portable units 640. When the eTabs deal is opened, the name of the eTab game, the form number, the number of cards, the price of the card, the definite payout in dollars and percentage, the definite profit in dollars and percentage, the win ratio, the win amount tiers, and the like should preferably be shown for the operator and players to review. The typical tiers might be 16 winners at $100, 4 winners at $50, 4 winners at $15, 10 winners at $5 and 250 winners at $1.

The gaming system can offer pull-tab deals in a myriad of sizes including, but not limited to, 1999 to 8448 tickets (the standard paper pull-tab single box); 12,000 tabs per box; and also the ability to offer much larger, or "Mega," deals. The size of the deal will limit how often new deals are downloaded to the halls. "Mega" deals can start in the 100,000's or even Millions, but may need to be adjusted based on customer preference.

The payout for paper pull-tabs can be as low as 50% and as high as 98%, but most fall between 65% and 93%. The gaming system allows the payout percentage to be determined and adjusted for each deal.

Players at player units 650 and portable units 640 can play an eTab game similar to that of FIG. 5. Players purchasing pull-tab games from a POS unit 630 can have a game card printed via printers 635, 637. A printed game card is preferably played in a manner similar to a traditional pull-tab game, except that a serial number is assigned to the card at the time a print request is sent. The printed ticket preferably has an associated barcode or serial number displayed thereon which could then permit a player to go to player unit 650 or portable unit 640 to obtain and/or verify the results. The player can enter the serial number or scan the barcode into a unit and plays the eTab game or simply views the game outcome. In addition, as will be described in more detail later below, a player can use a video enhanced device which can provide visually stimulating feedback if the ticket is a winner. Such graphical depiction might include a simulated race or slot machine type display.

Although the gaming units allow players to graphically determine whether purchased paper pull-tab games are winners, the barcode on a paper pull-tab ticket can also be read at any POS unit 630 and the player can immediately have the bar code scanned at any POS unit 630 and be paid (if they won) without playing any of the tabs at a gaming unit. The same is preferably true if the player only played part of the eTabs that they purchased at a gaming unit. The bar code on the receipt will preferably provide complete information on an eTab purchase. This will be true for eTabs purchased at POS unit 630 as well as eTabs purchased from player stations.

Deals may be loaded on Central eTabs Game Servers 695, 696 via CD-ROM or other secure read-only methods. Central servers 696, 695 are preferably designed as fault-tolerant and redundant central game servers. Should one of servers 695 or 696 fail, the other server will preferably take up operation. Servers 695, 696 should be located in an access-controlled area. Servers 695, 696 can periodically validate the version and software running on the local game servers 600, 605. All system data records shall preferably be stored in a secured, encrypted manner. All critical data communication within the gaming system will preferably be transmitted via a secure, digitally signed means such as that described above for the dial-in system.

The eTabs should be stored in a virtual black box on servers 695, 696. This can be accomplished by implementing at least one of central servers 695, 696 as a Card/Starts Server. Individual tickets, subsections of deals, and deals can be distributed to local game servers 600, 605 via network 682 or the like. Alternatively, deals may be loaded onto one or more of local game servers 600, 605 via CD ROM or other secure, read-only method, or created dynamically upon opening of a new deal. The eTabs may further be stored in a secure, virtual black box on local game servers 600, 605. This can be accomplished be implementing at least one of local game servers 600, 605 as a Card/Starts server.

Local game servers 600, 605 are preferably designed as fault-tolerant and redundant machines. Should local game server 600 fail, server 605 can seamlessly take up operation. Further, local game servers 600, 605 are also preferably equipped with power off tamper detection, and the physical cases thereof can be security taped, tagged, or otherwise sealed. All gaming system software and related files are preferably stored in a secure, digitally signed manner in game servers 600, 605.

The eTab distribution database stored on POS units 630 is preferably written and digitally signed in a secure manner.

All software versions should be checked on portable units 640 prior to POS units 630 commencing sale. This can be accomplished be digitally authenticating a randomly selected portable program subsection from portable unit 640.

An advantage of the architecture outlined above is that it allows players to participate in eTabs games from the same units on which Bingo and other games are played. Another advantage of the gaming system is its use of abstraction to enhance the overall usefulness of the gaming system by not limiting a particular set of eTabs outcomes to a specific game. By way of example, without intending to limit the gaming system, even though a set of eTabs outcomes may be purchased by a gaming hall with the intention to use the outcomes with a tropical island themed pull-tab style game, including background graphics of palm trees and beaches, and game indicia of cocoanuts, pineapples, and various types of sea shells hidden behind virtual tabs, the gaming hall may decide to try slot-machine style games on a set of player units, and can use the eTabs outcomes to generate such a game. In such an embodiment, reels resembling traditional slot-machine reels may appear to rotate on the player's screen, with an eTabs outcome ultimately determining the set of symbols displayed on the slot-machine reels as the game result. The only change necessary to permit such a new game to be played is to add the appropriate user interface generation software, or game software, on a player unit or portable unit.

The system is preferably designed to allow each hall or operator to have more than one deal open at a time. It is expected that at most halls the different open deals will be of different denominations and game themes. Further, once a game or theme is loaded onto the operator's computer, that game or theme could be played over and over again.

Not only can the game style be changed in this gaming system, such as from a pull-tab game to a slot-machine game, but the indicia used within a game can also be altered. Thus, returning to the previous example, the slot-machine reels may include traditional slot machine indicia, including bars, cherries, lemons, bells, and the like, rather than being limited to a tropical theme as with some systems in the prior art. By permitting such flexibility, the gaming system allows gaming halls to maximize return on investment by reducing the number of gaming systems needed to roll out new and different games.

Still further, the gaming system allows gaming halls to change the games available on an as needed or as desired basis. Thus, for example, a gaming hall may know in advance that a large group is coming to the gaming hall, and that the group has a common interest, such as quilt making. The gaming hall may provide quilt making related indicia to a set of player units and/or portable units, thereby making them more interesting to the group. Alternatively, if the gaming hall knows that a concert is being performed that will draw patrons of a given age group, games more attractive to that age group may be rolled out more prevalently than on a normal night. In still another example of the flexibility afforded by the gaming system, the gaming hall can monitor player interest in a given game or set of games, and dynamically alter the number of player units on which games are made available as player demand increases.

This flexibility comes from the abstraction implemented throughout the gaming system. A preferred abstraction means will now be described in detail. Although the described abstraction means is presently preferred, it should be apparent to one skilled in the art that alternative abstraction means may be substituted therefor without departing from the spirit or the scope of the gaming system. In this description, a theme is the most general term used to describe a game. A theme embodies the indicia, sounds, paylines, and special rules associated with the game. Each theme implemented in the gaming system is preferably given a unique Theme ID.

Another term used in this description is "group". A group refers to a collection of decks (described below) which are logically linked and should be opened or closed together. Usually this link exists because the decks in question represent different aspects of a larger game. For example, if a gaming hall wanted to run a "Sunken Treasure" themed, Slot-style game with an 82% payout ratio, and allow players to play as many as nine lines, the gaming all would open nine individual decks, one for each lines available for play. This set of nine decks would all be a part of the same group, such as the "The Sunken Treasure @ 82% group." Each group is preferably given a unique group ID, and will be associated with a Theme ID.

Decks are abstractions representing a specific set of tickets associated with an instance of a game theme. It specifies everything about a game except the order in which the tickets will be used and the denomination of the game. Thus, the tickets are preferably stored sequentially in the deck. Each deck has associated with it a precise theme, return percentage, payout structure (in credits), and number of lines played. Each deck will be given a unique deck ID, and will be associated with a group ID.

The deal is the most specific set of tickets in the hierarchy. It is a deck to which a specific denomination and a specific order have been applied. Each deal will be given a unique deal ID, and will be associated with a deck ID.

FIG. 7 is a block diagram illustrating the use of abstraction to represent a multi-line, multi-denomination game. Each box in the diagram represents a different deal, and each deal is used only when a player chooses the associated denomination/lines-played combination. Each column of the diagram represents a set of deals derived from the same deck. Note that each of these, in addition to being associated with a different denomination will also be in a different shuffled order. A player who chooses four paylines at 50 cents, for example, will pay 4×50¢=$2 and receive one ticket from deal 14 (deck 3). A player who chooses 1 pay line at 10 cents, will pay 1×10¢=10¢ and receive one ticket from deal 0.

FIG. 7 as a whole represents a group, the group associated with a specific instance of a four-line, four-denomination slot-style game. The theme, in turn, will preferably contain a plurality of such groups, each group representing a different instance of the game, with variations of the paytable, return percentage and award distribution.

As previously described, an eTab tab-style game differs from an eTab slot-style game only in that the player does not have a choice regarding the number of lines played when buying a tab in the eTab tab-style game. For this reason, an eTab tab-style group will typically contain only one deck. Thus, if an eTab tab-style game were represented in a manner similar to FIG. 7, it would contain only one column of deals.

For each theme, at least one file will preferably be created which contains all the information necessary for the system to implement the theme. A theme file will preferably contain:

Theme Specific Data
Theme table
  Theme Id
  Name
  Number of Reels

- Visible symbols per reel
- Symbol Count
- Pay line table
  - Pay line Id
  - Theme Id
  - Reel Number (an index value starting from left to right, zero based)
  - Index value (relative to the top of top visible symbol, also zero based)
- Theme resource file (background screen image)
- Theme layout file (in an INI type format)
- Theme flic file (pull back tab animation, etc)
- Player won animation (if there is one)
- Sound Files
  - Generic support sounds
    - spinning reels sound
    - peeling tab sound
  - Theme specific sounds
    - player won sound
    - non-event specific ambience sounds
- Group Specific Data
- Group Table
  - Group Id
  - Group Name
  - Theme Id
- Deck Specific Data
- Reel Definition Table
  - Reel Number
  - Reel Symbol
  - Reel Index
- Deck Definition Table
  - Deck Id
  - Theme Id
  - Group Id
  - Payout percentage
  - Profit (in credits)
  - Modulus
  - Multiplier
  - Number of lines bet
  - Total number of tickets (deck size)
  - Hit Rate=Win Ratio (fraction of tickets that win something)
- Remap Table
  - Deck Id
  - Ticket Index
  - Ticket Number
- Payout definition
  - Deck Id
  - Symbol count (the number of times this symbol is repeated for a win)
  - Packed value (the result of packing the symbol id, "symbol count" number of times.
  - Payout amount
  - Bonus Flag (does this trigger a bonus game)
  - Number of occurrences (in this deck)
- Deal Specific Data
- Deal Table Information
  - Deal Id
  - Deck Id
  - Denomination
  - Price per ticket
  - Expire Date
  - Increment (seed value for the shuffler)
  - Initial Ticket Index (another seed for the shuffler)

Although the theme file described above includes information specific to displaying game outcomes using slot-type and pull-tab type games, it should be apparent to one skilled in the art that the them file can be modified to allow many different visual representations of game outcomes.

When a player purchases a game card with game outcomes for a given theme, the gaming system determines the individual game outcomes to be assigned to the player based on the ticket index associated with the individual game outcomes in the deck. Ticket indices range from zero to the number of game outcomes in the deal minus one. A shuffle algorithm is preferably used to determine the next game outcome to be dispensed. Game outcome shuffling is advantageous as it reduces the likelihood of a gaming hall operator, gaming hall employee, or player being able to predict when winning game outcomes will be presented by the gaming system. Although a random number based game outcome shuffler is acceptable in certain jurisdictions, some jurisdictions do not allow game outcomes to be randomly shuffled because of monitoring and testing concerns. Thus, it is presently preferred that a shuffle algorithm be implemented which provides an apparently random game outcome shuffle, but which can actually be accurately predicted at any time based on the ticket index previously of the dispensed game outcome. A formula for such a shuffler is:

$$\text{NextTicketIndex}=(\text{Multiplier}*\text{PreviousTicketIndex}+\text{Increment})\%\ \text{Modulus}$$

The formula is applied iteratively until $0<=\text{NextTicketIndex}<\text{DeckSize}$, where DeckSize is the number of game outcomes in the deck minus one.

The values used by the shuffler should be chosen carefully if an apparently random order is desired, and to avoid repetition of ticket indices. An explanation of the restrictions which must be applied to each of these constants is given below.

Modulus must always be a power of 2, and should be at least 5 to 10 times as large as the number of tickets in the deck. This implies that the above formula will be iterated an average of 5 to 10 times for each new tab sold. These extra iterations aid in producing a less humanly-predictable order and increase the number of different shuffles which can be applied to the deck. Modulus is preferably included in the deck specific data of the Theme Definition File.

Multiplier is one of a list of constants, each associated with a particular Modulus (see FIG. 17). Such constants are preferably generated via a search for values which would produce all numbers from 0 to (Modulus-1) before repeating, and would do so in an apparently random order. There should not be a need to use multipliers other than those listed in FIG. 17, but if they ever need to be changed, (Multiplier-1) must be a multiple of 4 or the shuffle will start to repeat without producing all the index values. Furthermore, to achieve apparently random behavior, (Multiplier % 8) should be equal to 5, and Multiplier should not be close to 0 nor close to Modulus ($0.01*\text{Modulus}<\text{Multiplier}<0.99*\text{Modulus}$ is a good "rule of thumb"). Multiplier is preferably included in the deck specific data of the Theme Definition File.

Increment is the value that will change with different deals of the same deck. The same Increment should not be allowed to occur in two deals of the same deck. Mathematically, the only limitations on Increment are that it should be odd, and should be less than the Modulus. An Increment value is preferably included in the deal specific data of the Theme Definition File.

PreviousTicketIndex is simply the index of the previously distributed game outcome. When a deal is first opened, there will be no previously sold game outcomes, and consequently an initial value should be chosen for PreviousTicketIndex.

Any Initial Ticket Index value can be chosen, provided such index has a value greater than the number of game outcomes in the deck, but less than the Modulus. An Initial Ticket Index is preferably included in the deal specific data of the Theme Definition File.

DeckSize is equal to the number of tickets in the deck. It is included in the deck specific data of the Theme Definition File.

Thus, by way of example, the following modulus, multiplier, and increment may be chosen for a DeckSize of 100,000:

Modulus=65536
Multiplier=47485
Increment=25531

The following is an example of the derivation of the NextTicketIndex based on these values. This example is intended as an illustration of the process, and should not be construed as limiting the process to specific values. For the purposes of this example, assume this is not a new deal, and that the previous ticket index was 0 (i.e. the first ticket in the deal). Thus, PreviousTicketIndex=0

The formula is iteratively applied until a value is obtained between 0 and 10,000:

```
NextTicketIndex = (47485 * 0 + 25531)%65536 = 25531
                = (47485 * 25531 + 25531)%65536 = 14602
                = (47485 * 14602 + 25531)%65536 = 30621
                = (47485 * 30621 + 25531)%65536 = 16484
                = (47485 * 16484 + 25531)%65536 = 6287
```

So the Next Ticket Index to be used is 6287.

In theory, a deal could be created wherein the deal contains enough ticket indices to allow for all possible game outcomes to be represented within the deal. However, it is frequently desirable for a deal to contain fewer game outcomes than can possibly be created. Instead, the gaming system preferably picks and chooses from among the possible game outcomes to create a desired Return Percentage and Award Distribution.

A Remap Table, preferably included in the deck specific data of the Theme Definition File, contains a list of the ticket numbers which correspond to these "hand picked" game outcomes and can be used to associate each Ticket Index with a new Ticket Number. The Ticket Index is used as an index into the Remap table:

TicketNumber=Remap[TicketIndex]

Recall that the ticket index calculated above was 6287. However, this is not the number which will be used determine the outcome of the game. Instead, the value corresponding to the ticket index is looked up in the Remap Table to find the number which will be used. For the sake of the ongoing example, the Remap table may produce:

TicketNumber=Remap[6287]=106595

Thus, the ticket number associated with TicketIndex 6387 is 106595. Next, this Ticket Number can be mapped into a collection of indicia to be displayed to a player and to be use in determining any awards which the game outcome might yield.

Each position on the screen which can display an indicia is given a unique Symbol Location Index. By way of example, in a slot-type game, these locations can be assigned in sets to different Reels, as described in the Theme Layout data in the Theme Specific section of the Theme Definition File. Each Symbol Location can be populated by an indicia from its assigned reel in the final display to the player.

There may also be Symbol Locations which are invisible to the player. They will hold information which is not displayed to the player as a symbol, but which is used to determine the award of the ticket. For example, the game Barnstorm Bonus produced by the assignee of this invention preferably uses invisible Symbol Locations to hold the indicia which determine the outcome of a bonus game.

Barnstorm Bonus is displayed as a five-window ticket in which each window contains three symbols. The display shown to the player is therefore an array of three columns by five rows similar to that illustrated in FIG. 8. However, as FIG. 8 further illustrates, the data used to represent the display may contain a fourth column of symbols not shown to the player. This "invisible" column can be used to determine the outcome of a bonus game, should one be triggered. Thus, to accommodate the display of FIG. 12, four reels may be created, one for each column, as illustrated in FIG. 8. The set of Symbol Locations defined in the Theme Data File may therefore include an array of four columns and five rows (one for each window).

Figures 10, 11, 12:
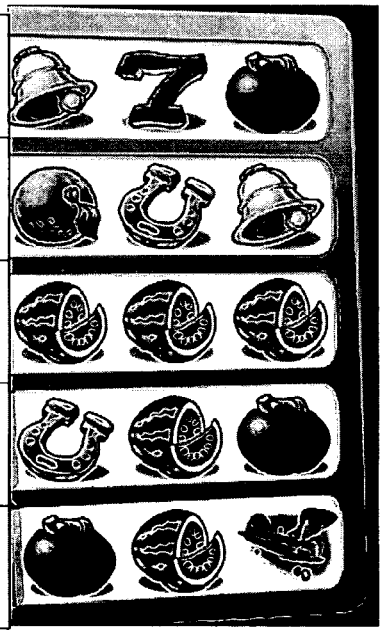
FIG. 10 is a sample CReel array.
FIG. 11 is a sample instance of a CReel table for a multi-line game.
FIG. 12 is a sample eTab user interface display for ticket number 106595 and a corresponding, populated DisplayReels array.

In the slot-like game outcome representation of FIG. 12, a Reel is a circular list of symbol ID's (unique identifiers linked to each symbol used in the game) similar to that of FIG. 15. Reels 0, 1, and 2 each contain thirty symbol ID's. Reel 3 (the "invisible" reel) uses six. The reels as defined for a Barnstorm Bonus game are illustrated in FIG. 15. Each reel is preferably defined in the Deck Specific data of the Theme Definition File, and is associated with a set of symbol locations by the Theme Layout data. The class CReel, illustrated in FIG. 10, is an array which can be used to store and symbol IDs of all indicia on each of the reels. CReel:: GetSymbol(i,j) will return the $j^{th}$ symbol on reel i.

Continuing with the Barnstorm Bonus example from above, the theme as defined uses seven different Symbol IDs. These Symbol IDs are illustrated in FIG. 9.

Once the reels and Symbol ID's have been defined, a Ticket Number can be broken down into a plurality of indices, one for each of the reels. A simple method for associating a unique combination of Reel Indices with each Ticket Number is preferable. Such a method can be accomplished by thinking of each of the reel indices as a single digit in a mixed base numerical representation of the Ticket Number. For example, if all of the reels contain twelve symbol IDs each, the Ticket Number can be represented in base 12 and each digit can be used as a reel index. If the first two reels contain 20 symbols each and the last two contain 30 symbols each, then we represent the Ticket Number as a mixed base numeral in which the two most significant digits are in base 20 but the two least significant digits are in base 30.

In practice, this can be done with a simple loop:

```
for (i=NumReels-1; i>=0; i--)
{
    ReelIndex[i]=TabNumber%NumSymbolsOnReel[i];
    TabNumber=TabNumber/NumSymbolsOnReel[i];
}
```

NumReels contains the number of reels, and NumSymbolsOnReel[i] contains the number of symbols on reel i.

As described above, the Barnstorm Bonus eTab game has 4 reels with 30, 30, 30, and 6 symbols on each one respectively. The Ticket Number above was 106595, so stepping through the loop above will gives the assignments:

Index[3]=106595%6=5
TabNumber=106595/6=17765
Index[2]=17765%30=5
TabNumber=17765/30=592
Index[1]=592%30=22
TabNumber=592/30=19
Index[0]=19%30=19
TabNumber=19/30=0

So our Reel Indices for Reel 0 through 3 are [19, 22, 5, 5] respectively.

DisplayReels (actually an instance of the CReel class discussed above), an example of which is illustrated in FIG. 11, is an array which preferably contains the Symbol ID's of all the indicia to be displayed on the screen, as well as any "invisible" indicia. In other words, DisplayReels contains one cell for each Symbol Location Index, and each of these cells will be loaded with a Symbol ID.

Each cell of the DisplayReels is filled by filling each column (i.e. each set of Symbol Locations which are associated with the same reel) in order with indicia from the corresponding Reel and using the indices calculated above as starting points. This puts the symbol ID from Reel i, ReelIndex[i]+j into cell (i,j) of DisplayReels. If ever ReelIndex[i]+j>=the number of Symbol IDs on that reel, this is "wrapped around" to GetSymbol(i,0). This is illustrated in FIG. 10.

Continuing with the ongoing example, our Reel Indices were ReelIndex[0]=19, ReelIndex[1]=22, ReelIndex[2]=5, and ReelIndex[3]=5, and the symbol ID's corresponding thereto are filled into the DisplayReels array as illustrated in FIG. 11. Note that in the fourth column, the index exceeds the number of symbol IDs in the Reel, so we "wrap around" from 5 back to 0.

Referring back to the Reel Definition Table of FIG. 15, it can be seen that Reel 0, index 19 contains Symbol ID 2, Reel 0, index 20 contains a 4, and so on. Substituting these Symbol ID's into FIG. 11 results in the array illustrated in the left-hand portion of FIG. 12. By looking up the corresponding indicia from the table in FIG. 9, a display similar to the right-hand portion of FIG. 12 can be generated.

The next step is to determine if there are any winning symbol combinations on any active paylines of the ticket. A payline is an ordered set of Symbol Locations whose indicia can be used to create a Winning Combination. The Payline Definition Table, which is preferably included in the Theme Specific data of the Theme Definition File, is a two-dimensional array that lists the Symbol Locations that make up each payline. "Payline[i][j]" will be used to refer to Symbol Location of the $j^{th}$ cell of the $i^{th}$ payline.

Continuing with the previous example, a typical Barnstorm Bonus game has five paylines, one for each horizontal row of indicia. As illustrated in FIG. 8, Payline[0][] would refer to the top row and would contain the values [0, 5, 10, 15]. Payline[1-4][] represent the other 4 horizontal lines in the same way. Although the example described herein uses only horizontal rows, it should be apparent to one skilled in the art that alternative playline arrangements can be substituted therefor without departing from the spirit or the scope of the gaming system. By way of example, without intending to limit the gaming system or its equivalents, it would have been just as easy to have used diagonal [0,6,12,18], zig-zag [1,11,7,17], or chaotic [12,9,19,6] paylines.

A Winning Combination is a collection of indicia which, when occurring on an active payline, entitles a player to an award and/or entrance into a bonus feature. WinCombos[] is a one-dimensional array, such as that illustrated in FIG. 13, containing information defining all possible winning combinations. WinCombos[]is preferably provided in the Deck Specific Data of the Theme Definition File.

WinCombos[] should be sorted in order of preferential award. If it is possible that the symbols on a payline could match the pattern necessary for more than one winning combination, it is preferable to list the award which they will be given first. For example, if "3 Cherries" pays 50, and "3 Any Fruit" pays 10, a payline containing 3 cherries fits both patterns, but would only be awarded the first. Consequently, "3 Cherries" should be listed before "3 Any Fruit" in a WinCombos definition.

The WinCombos[] array preferably includes data fields for NumCells, PackedWinNumber, Award, and Bonus. NumCells is simply the number of cells that need to contain specific indicia for this win combo. So for a payout of "3 watermelons", for example, this value would be 3. The Packed Win Number for any particular winning combination is found by treating the symbol ID's of the indicia which make up that win as a single integer using the total number of indicia in the game as the numeric base (i.e. if there are eight symbols, the number will be octal, if there are ten it will be decimal, etc.). This is the reverse of the process used to determine the Reel Indices. Award is simply an integer indicating how many credits that win combo earns, before any Bonus feature is applied. The Bonus field will be used differently in different games, and a plurality of Bonus fields may even be used. In Barnstorm Bonus, the Bonus field contains a multiplier that will be earned if a win combo calls for a Biplane Race Bonus, and a zero if no race occurs.

In Barnstorm Bonus, three-of-a-kind combinations earn awards. Additionally, the Biplane symbol (which occurs only on the third reel) acts as a wild symbol and triggers a Bonus Biplane Race. The award is then multiplied by 10, 5, or 2 if the plane bearing the winning combinations symbol finishes the race $1^{st}$, $2^{nd}$, or $3^{rd}$. There are six pre-fabricated races, whose outcomes allow for any plane to finish in any place.

Referring to FIG. 16, Barnstorm Bonus uses seven different Symbol IDs. As defined in FIG. 13, the fourth (invisible) reel uses the same ID numbers to refer to pre-fabricated races. Consider winning combination number three of FIG. 13, "3 Watermelons". The award for this winning combination is 10 credits, and it does not initiate a bonus race. Because a bonus race is not being run, the contents of the fourth reel can be ignored. Thus:

| | |
|---|---|
| WinCombo[14].NumCells = 3 | Only the first 3 symbols matter |
| WinCombo[14].PackedWinNumber = $333_7$ | 3 of symbol 3 out of 7 total symbols |
| = $171_{10}$ | |
| WinCombo[14].Award = 10 | 10 credits awarded |
| WinCombo[14].Bonus = 0 | No Bonus Race |

To check for wins, the Symbol IDs occupying each payline are used to create an array PackedLine[]. The dimension of this array is equal to the number of Symbol Locations in a payline plus one. PackedLine[N] represents the first N symbols of the payline taken as a single integer using the total number of symbols in the game as the numeric base. This is the same method that was used to create the Packed Win Numbers in the WinCombos[] table.

In the general case, PackedLine[] can be calculated for payline x by this loop:

```
PackedLine[0]=0;
for (i=0; i<NumCellsInPayline; i++)
PackedLine[i+1]=PackedLine[i]*NumSymbols+DisplayReels[Payline[x][i]];
```

Referring back to FIG. 12, it can be seen that the top row of the ticket, Payline[0], contains Symbol IDs [2, 0, 5, 5]. There are seven symbol IDs in the game, so our base is seven, and the Packed Line numbers for Payline[0] are;

| | |
|---|---|
| PackedLine[0] = $0_7$ | = 0 (this is always true) |
| PackedLine[1] = $2_7$ | = 2 |
| PackedLine[2] = $20_7$ | = 14 |
| PackedLine[3] = $205_7$ | = 103 |
| PackedLine[4] = $2055_7$ | = 726 |

By packing the other four paylines as well, we can create the table illustrated in FIG. 14. WinCombos[] can be searched one at a time looking for matches between the Packed Line Numbers and the Packed Win Numbers. In particular, a match exists with WinCombo[X] if:

```
(PackedLine[WinCombo[x].NumCells]==WinCombo[x].PackedWinNumber)
```

Using the Packed Line Numbers for Payline[0] (FIG. 14), the Packed Win Numbers of FIG. 13 can be searched for the first Winning Combination for which the Packed Line Number with the corresponding number of indicia is a match.

So, starting at WinCombo[0];

| | |
|---|---|
| WinCombo[0].NumCells = | 3 |
| WinCombo[0].PackedWinNumber = | 0 |
| PackedLine[3]= | 103 |

The Packed Win Number and the Packed Line Number do not match, so processing would continue to WinCombo[1], and so on. In the Packed Line Numbers of FIG. 14, a match is not found until:

| | |
|---|---|
| WinCombo[30].NumCells = | 0 |
| WinCombo[30].PackedWinNumber = | 0 |
| PackedLine[0]= | 0 |

WinCombo[30] (which requires zero symbols) will always produce a match. Finding a no match before this one indicates that Payline[0] does not hold a winning combination.

Payline 2, however, does contain a winner, three watermelons (and a surplus $4^{th}$ symbol which doesn't get used in this case). When the Packed Line Numbers of Payline two are searched for winners:

| | |
|---|---|
| WinCombo[3].NumCells = | 3 |
| WinCombo[3].PackedWinNumber = | 171 |
| PackedLine[3] = | 171 |

The Packed Win Number and the Packed Line Number match, so a winner of WinCombos[3] on Payline[2] has been found.

The WinCombos of each line are tracked in a one-dimensional array LineWin[]. This array, along with WinCombos[], is made available to the presentation layer, enabling it to extract all the info it needs for display purposes.

Win Amount for Line X=WinCombos[LineWin[X]].Award

Bonus Info for Line X=WinCombos[LineWin[X]].Bonus

Etc.

After checking all five lines of the sample Barnstorm Bonus ticket of FIG. 12, it can be determined that PayLines 0, 1, 3, and 4 all match WinCombo[30] and PayLine 2 matches WinCombo[3]. LineWin[] is therefore [30,30,3,30, 30].

By permitting the Presentation Layer to access LineWin[] and WinCombo[], the Presentation Layer can extract the amount won on PayLine 2;

| | |
|---|---|
| Win Amount for Line 3 = | WinCombos[LineWin[2]].Award |
| | = WinCombos[3].Award |
| | = 10 |

While the invention has been described in detail and with reference to specific embodiments thereof, it will be apparent to those skilled in the art that various changes and modifications can be made therein without departing from the spirit and scope thereof. Thus, it is intended that the gaming system cover the modifications and variations of this invention provided they come within the scope of the appended claims and their equivalents.

What is claimed is:

1. A method for generating an electronic pull tab game, comprising:

generating a deck of pull tab tickets that specifies for each of the pull tab tickets, a game theme specifying game outcome display indicia, a number of pull tab lines played, and a ticket index that specifies a game outcome;

generating a deal of the pull tab tickets within the deck, wherein the deal specifies a monetary denomination and a sequential order of one or more of the pull tab tickets within the deck; and responsive to a purchase transaction for a pull tab ticket within said deck:

shuffling the deck of pull tab tickets using a linear congruential algorithm to select a pull tab ticket index from the pull tab ticket indices, said linear congruential algorithm comprising the formula:

NextTicketIndex=(Multiplier*PreviousTicketIndex+Increment)/Modulus, wherein NextTicketIndex represents the selected pull tab ticket index, Modulus represents a specified modulus value, Multiplier represents a constant associated with the specified modulus value, wherein the specified modulus value is a power of two and is at least five times greater than the number of the pull tab tickets in said deck, PreviousTicketIndex represents the previously issued pull tab ticket index, and Increment represents an odd integer that is uniquely associated to said deal from among other deals within said deck and is less than the value for Modulus; and, assigning the selected pull tab ticket index specified by NextTicketIndex.

2. The method of claim 1, wherein the linear congruential algorithm is designed not to repeat until all of the pull tabs in the deck have been selected.

3. The method of claim 1, wherein at least one of the pull tab tickets is designated as a winning tab in accordance with its pull tab ticket index, said method further comprising dividing the set of winning pull tabs into a plurality of subsets.

4. The method of claim 3, wherein each of the plurality of subsets has a different number of winning pull tabs.

5. The method of claim 4, further comprising assigning at least one win amount to the subsets.

6. The method of claim 1, further comprising selecting a plurality of outcome display indicia to be associated with the deal, wherein at least one combination of indicia serves as a winning combination.

7. The method of claim 3, further comprising selecting a plurality of outcome display indicia to be associated with the deal, wherein at least one combination of indicia serves as a winning combination.

8. The method of claim 7, further comprising assigning at least one winning indicia combination to each of the plurality of subsets.

9. The method of claim 8, further comprising selecting a price players should be charged for a pull tab ticket, and associating a win value with each of the plurality of subsets.

10. The method of claim 9, further comprising making at least the pull tab ticket price and win values known to players.

11. The method of claim 1, wherein said ticket index is specified as a serial number, said method further comprising printing a game card specifying the serial number in a machine readable fonnat.

12. The method of claim 1, wherein Decksize is the number of pull tab tickets in said deck, and wherein said ticket indices of the pull tab tickets in said deck are numeric values ranging between 0 and (Decksize −1), said method further comprising applying said linear congruential algorithm iteratively until a generated NextTicketIndex value is greater than or equal to 0 and less than Decksize.

13. A system for generating an electronic pull tab game, comprising:

means for generating a deck of pull tab tickets that specifies for each of the pull tab tickets, a game theme specifying game outcome display indicia, a number of pull tab lines played, and a ticket index that specifies a game outcome;

means for generating a deal of the pull tab tickets within the deck, wherein the deal specifies a monetary denomination and a sequential order of one or more of the pull tab tickets within the deck; and means responsive to a purchase transaction for a pull tab ticket within said deck for:

shuffling the deck of pull tab tickets using a linear congruential algorithm to select from the pull tab ticket indices, said linear congruential algorithm comprising the formula:

NextTicketIndex=(Multzplier*PreviousTicketIndex+Increment)/Modulus, wherein NextTicketIndex represents the selected pull tab ticket index, Modulus represents a specified modulus value, Multiplier represents a constant associated with the specified modulus value, wherein the specified modulus value is a power of two and is at least five times greater than the number of the pull tab tickets in said deck, PreviousTicketIndex represents the previously issued pull tab ticket index, and Increment represents an odd integer that is uniquely associated to said deal from among other deals within said deck and is less than the value for Modulus; and, assigning the selected pull tab ticket index specified by NextTicketIndex.

14. The system of claim 13, wherein the linear congruential algorithm is designed not to repeat until all of the pull tabs in the deck have been selected.

15. The system of claim 13, wherein at least one of the pull tab tickets is designated as a winning tab in accordance with its pull tab ticket index, said system further comprising means for dividing the set of winning pull tabs into a plurality of subsets.

16. The system of claim 15, wherein each of the plurality of subsets has a different number of winning pull tabs.

17. The system of claim 16, further comprising means for assigning at least one win amount to the subsets.

18. The system of claim 13, further comprising means for selecting a plurality of outcome display indicia to be associated with the deal, wherein at least one combination of indicia serves as a winning combination.

19. The system of claim 15, further comprising means for selecting a plurality of outcome display indicia to be associated with the deal, wherein at least one combination of indicia serves as a winning combination.

20. The system of claim 19, further comprising means for assigning at least one winning indicia combination to each of the plurality of subsets.

* * * * *